US012502000B1

(12) United States Patent
Liu

(10) Patent No.: US 12,502,000 B1
(45) Date of Patent: Dec. 23, 2025

(54) EXTENDABLE FRAME FOR FURNITURE, AND SOFA HAVING THE SAME

(71) Applicant: Dongguan Weihong Smart Home Technology Co., Ltd., Guangdong (CN)

(72) Inventor: Qiaowei Liu, Guangdong (CN)

(73) Assignee: DONGGUAN WEIHONG SMART HOME TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 18/964,464

(22) Filed: Dec. 1, 2024

(30) Foreign Application Priority Data

Aug. 15, 2024 (CN) ..... 202411120668.X
Oct. 30, 2024 (CN) ..... 202411539214.6

(51) Int. Cl.
*A47C 1/034* (2006.01)

(52) U.S. Cl.
CPC ..... *A47C 1/0342* (2013.01)

(58) Field of Classification Search
CPC ..... A47C 1/0345; A47C 1/035; A47C 1/0355; A47C 1/0342
See application file for complete search history.

(56) References Cited

U.S. PATENT DOCUMENTS

| | | | | |
|---|---|---|---|---|
| 10,881,209 | B2 * | 1/2021 | Bryant | A47C 1/0347 |
| 11,564,498 | B1 | 1/2023 | Li et al. | |
| 2025/0000260 | A1 * | 1/2025 | Cai | A47C 1/0355 |
| 2025/0040709 | A1 * | 2/2025 | Lake | A47C 1/0355 |

FOREIGN PATENT DOCUMENTS

| | | | |
|---|---|---|---|
| CN | 209269107 | U | 8/2019 |
| CN | 113616026 | A | 11/2021 |
| CN | 215913918 | U | 3/2022 |
| CN | 216494448 | U | 5/2022 |
| CN | 218127658 | U | 12/2022 |
| CN | 117045064 | A | 11/2023 |
| CN | 221012563 | U | 5/2024 |
| EP | 3949808 | A1 | 2/2022 |
| WO | 2019144434 | A1 | 8/2019 |

* cited by examiner

*Primary Examiner* — Milton Nelson, Jr.
(74) *Attorney, Agent, or Firm* — SHIMOKAJI IP

(57) ABSTRACT

An extendable frame for furniture suitable for zero-clearance wall applications includes a base frame, a backrest device, a seat frame, a backrest control assembly, a footrest device, a seat frame control assembly, a linkage assembly and a backrest control assembly. The linkage assembly is respectively hinged to the footrest device and the inner linkage assembly. The backrest control assembly is hinged to the backrest device, the seat frame, and the base frame. When switching from the retracted position to the extended position, the footrest device drives the seat frame control assembly through the linkage assembly, to switch from the initial position to the preset intermediate position. During a process where the backrest device follows the seat frame from the preset intermediate position to the terminal position, the backrest control assembly adjusts the angle of the backrest device.

11 Claims, 24 Drawing Sheets

1000

EXTENDABLE FRAME FOR FURNITURE, AND SOFA HAVING THE SAME

FIELD OF THE INVENTION

The present invention relates to the field of furniture, particularly to an extendable frame for furniture and a sofa having the same.

BACKGROUND OF THE INVENTION

With the continuous development of the economy and the progress of society, more and more consumer goods are being provided to improve people's lives, among which sofas are a common example.

Currently, adjustable armrest floor sofas are equipped with an inner extendable metal frame. This extendable metal frame includes a footrest device, a seat cushion device, and a backrest device, by a series of mechanical linkages, the relative positions and angles, the seat cushion, and the backrest can be adjusted, thereby allowing the sofa to switch between sitting, reclining, and fully reclined positions to meet user needs.

However, in existing extendable metal frames, the footrest device directly drives the backrest device during extension, causing the backrest to tilt backward. This backward tilting takes up space behind the sofa, thus the sofa can't be placed flush against a wall. When the back of the sofa is to be placed against a wall, the backrest device may collide with the wall during the footrest extension process, causing both the backrest angle adjustment and the footrest extension to fail.

Additionally, in the footrest devices of the current extendable metal frame, the rear end of the first long connecting arm is hinged to the lower end of the rear footrest swing arm, and the rear end of the second long connecting arm is hinged to the lower end of the front footrest swing arm. Both the front and rear footrest swing arms are hinged to the seat frame at their upper ends, which results in the footrest device occupying a large amount of vertical space during its extension and retraction process.

Therefore, there is an urgent need for an extendable frame for furniture and a sofa equipped with this extendable frame to overcome one or more of these issues.

SUMMARY OF THE INVENTION

An objective of the present invention is to provide an extendable frame for furniture, which is suitable for zero-clearance wall applications.

Another objective of the present invention is to provide a sofa which is suitable for zero-clearance wall applications.

In order to achieve the objectives mentioned above, the present invention provides an extendable frame for furniture including a base frame, a seat frame, a backrest device, a footrest device, a seat frame control assembly, a linkage assembly and a backrest control assembly. The seat frame is movable relative to the base frame in a front-rear direction and is provided with at least an initial position, a preset intermediate position, and a terminal position. The backrest device is installed at a rear end of the seat frame, and the footrest device is installed at a front end of the seat frame and capable of switching between a retracted position and an extended position; and the seat frame control assembly is installed between the seat frame and the base frame to control a front-rear movement of the seat frame relative to the base frame. The seat frame control assembly includes an outer linkage assembly that is an outer multi-bar linkage formed with the base frame, an inner linkage assembly that is an inner multi-bar linkage formed with the seat frame, and a transmission assembly connecting the outer linkage assembly to the inner linkage assembly. A head end of the linkage assembly is hinged to the footrest device, and a tail end of the linkage assembly is hinged to the inner linkage assembly. The backrest control assembly is hinged to the backrest device, a rear end of the seat frame, and a rear end of the base frame; when switching from the retracted position to the extended position, the footrest device drives the seat frame control assembly through the linkage assembly, enabling the seat frame and the backrest device to move together from the initial position to the preset intermediate position, with a forward movement of the seat frame being slower than an extension of the footrest device. During a process where the backrest device follows the seat frame from the preset intermediate position to the terminal position, the backrest control assembly adjusts the angle of the backrest device.

Compared with the prior art, the linkage assembly of the present invention at its head end is hinged to the footrest device and at its tail end is hinged to the inner linkage assembly, and the backrest control assembly is respectively hinged to the rear end of the base frame, and the backrest device, thus, during the process of switching from the retracted position to the extended position, the footrest device drives the seat frame control assembly through the linkage assembly, causing the seat frame and the backrest device to switch together from the initial position to the preset intermediate position. When the seat frame and the backrest device are together switched to the preset intermediate position, the backrest control assembly controls the backrest device for angle adjustment. By this token, the angle adjustment of the backrest device 70 only occurs when the backrest device follows the seat frame to the preset intermediate position, which provides spatial clearance for the angle adjustment of the backrest device, thereby making the sofa having the extendable frame of the present invention suitable for zero-clearance wall applications. Moreover, the seat frame control assembly includes an outer linkage assembly that is an outer multi-bar linkage formed with the base frame, an inner linkage assembly that is an inner multi-bar linkage formed with the seat frame, and a transmission assembly connecting the outer linkage assembly to the inner linkage assembly, thus the extending footrest device drives the seat frame forward through the linkage assembly, the inner linkage assembly, transmission assembly, and outer linkage assembly. As a result, when the seat frame and the backrest device are switched from the initial position to the preset intermediate position, the forward movement of the seat frame is slower than the extension of the footrest device, bringing small change of the seat frame relative to the base frame, thereby obtaining a preferable reclining position (TV watching mode).

In order to achieve the objectives mentioned above, a sofa of the present invention includes a backrest, a seat cushion and the extendable frame for furniture mentioned above. The backrest is mounted on the backrest device, and the seat cushion is mounted on the seat frame

DETAILED DESCRIPTION OF ILLUSTRATED EMBODIMENTS

To provide a detailed explanation of the technical content, and structural features of the present invention, the following is further explained in conjunction with the implementation method and the accompanying drawings.

Figure 1:
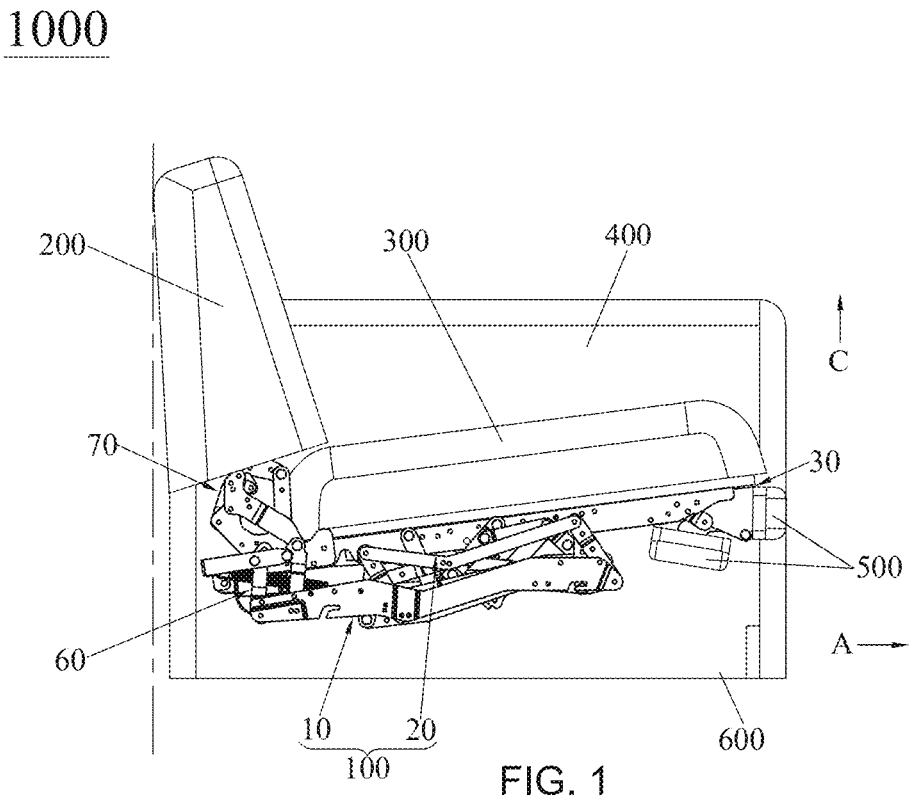
FIG. 1 is a plane view of the sofa in a seated position (also called as closed mode) according to the present invention, viewed from right to left, with the protective body on the right side hidden, the footrest device in the retracted position, and the seat frame in the initial position.
Figure 2:
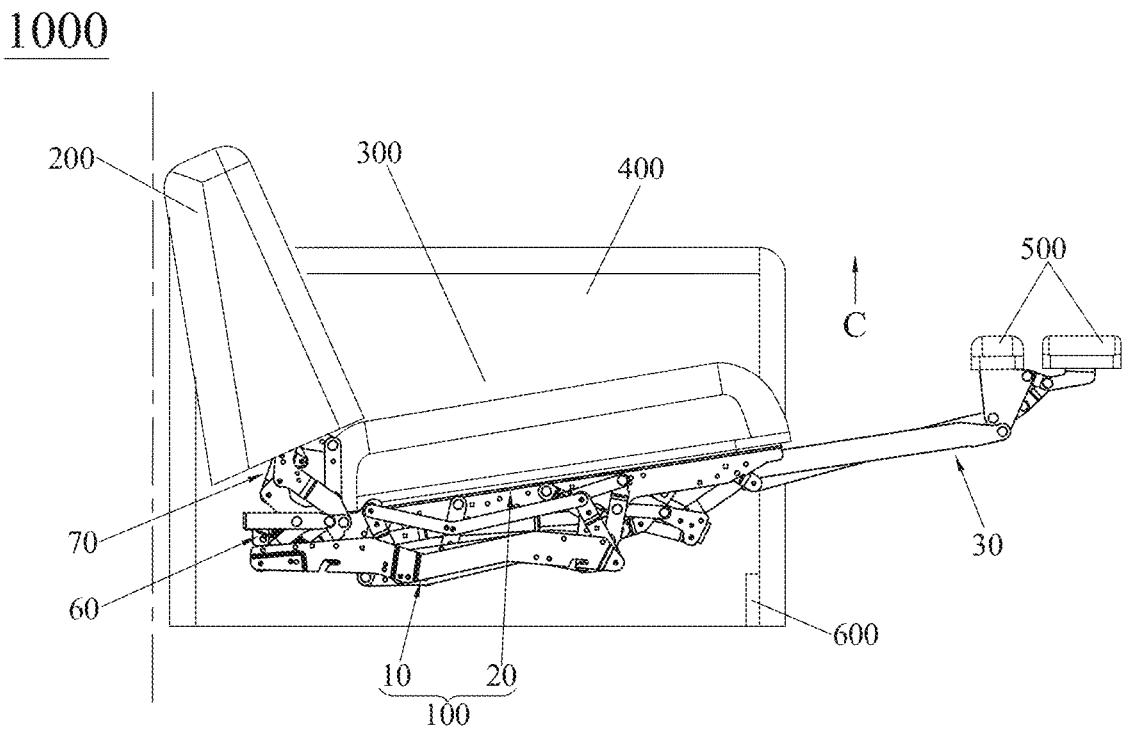
FIG. 2 is a plane view of the sofa in a reclining position (also called as TV watching mode), viewed from right to left, with the protective body on the right side hidden, the footrest device in the extended position, and the seat frame in the preset intermediate position.
Figure 3:
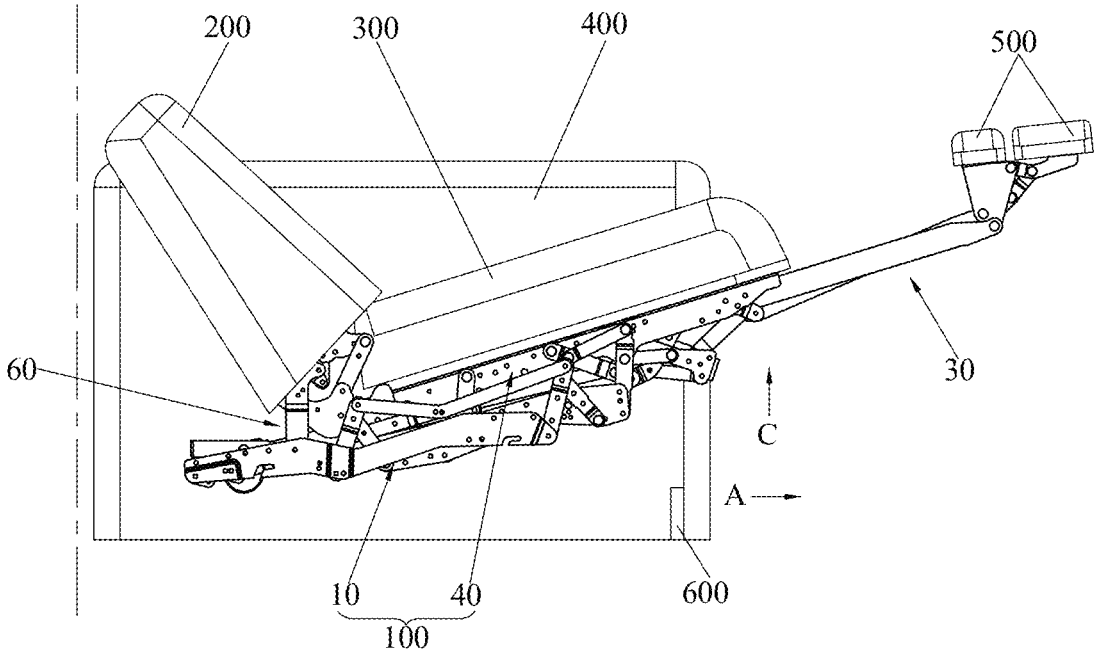
FIG. 3 is a plane view of the sofa in a fully reclined position (also called as relaxed mode), viewed from right to left, with the protective body on the right side hidden, the footrest device in the extended position, and the seat frame in the terminal position.

Referring to FIGS. 1 to 3, the sofa 1000 of the present invention includes an extendable frame 100 for furniture according to a first embodiment, a backrest 200, and a seat cushion 300. The backrest 200 is mounted on a backrest rotating frame 70 described thereinafter, and the seat cushion 300 is installed on a seat frame 20 described thereinafter. Through the operation of the extendable frame 100 for furniture, the sofa 1000 can switch among a seated position (also called as closed mode) shown in FIG. 1, a reclining position (also called as TV watching mode) shown in FIG. 2, and a fully reclined position (also called as relaxed mode) shown in FIG. 3, to meet the user's needs.

Specifically, as shown in FIGS. 1 to 3, as an embodiment, the sofa 1000 further includes armrests 400 located on both the left and right sides of the backrest 200 and the seat cushion 300, footrests 500 mounted on the footrest device 30 described below, and a front support frame 600 arranged under the front lower part of the extendable frame 100 for furniture. The backrest 200 and the seat cushion 300 are located between the two armrests 400. The front support frame 600 is fixedly connected to the armrests 400 on both sides, the extendable frame 100 for furniture is located between the armrests 400, and the base frame 10 of the extendable frame 100 for furniture, as described below, is fixedly connected to the armrests 400. In such a way, the armrests 400 provide an assembly location and support for the extendable frame 100 for furniture. It should be noted that, although FIGS. 1 to 3 show that the sofa 1000 includes armrests 400 located on both sides of the backrest 200 and the seat cushion 300, the footrests 500 mounted on the footrest device 30, and the front support frame 600 arranged under the extendable frame 100 for furniture, the sofa 1000 of the present invention is not limited to that shown. For example, the front support frame 600 may be omitted.

Figure 4:
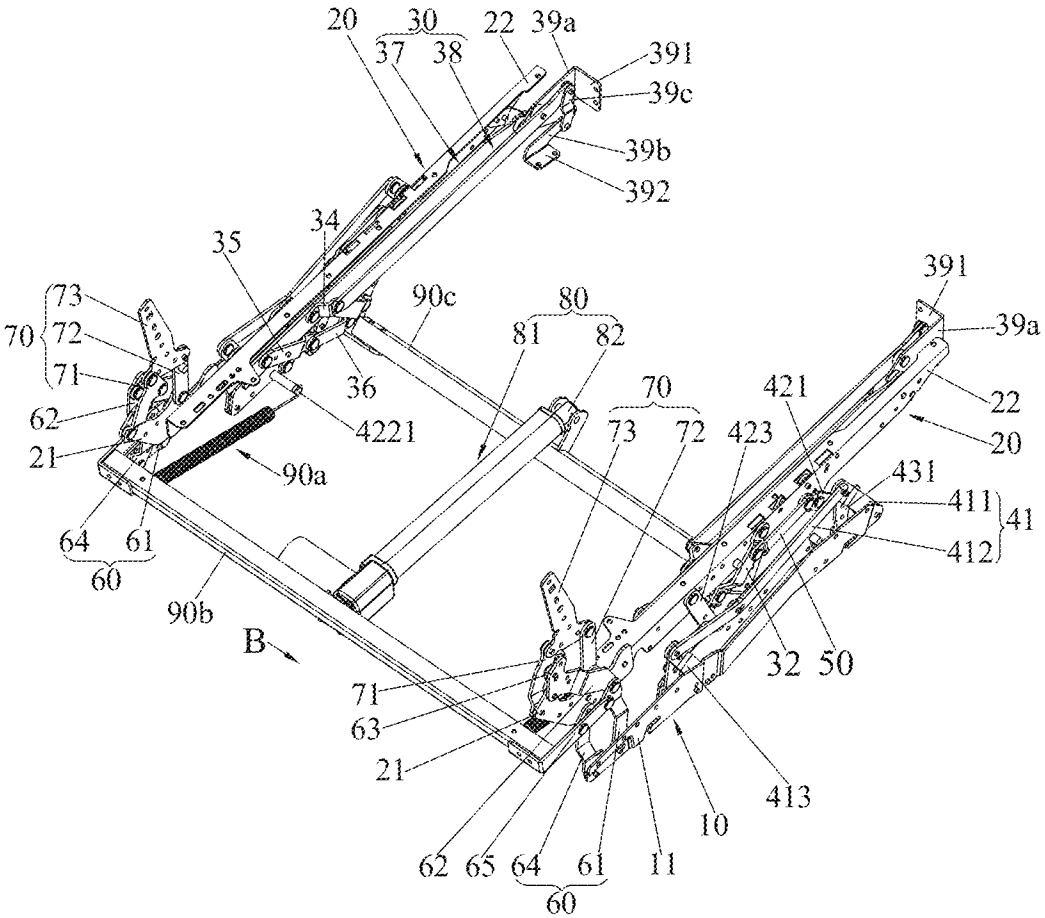
FIG. 4 is a perspective view of the extendable frame for furniture in the first embodiment of the present invention, with the footrest device in the retracted position, and the seat frame in the initial position.
Figure 6:
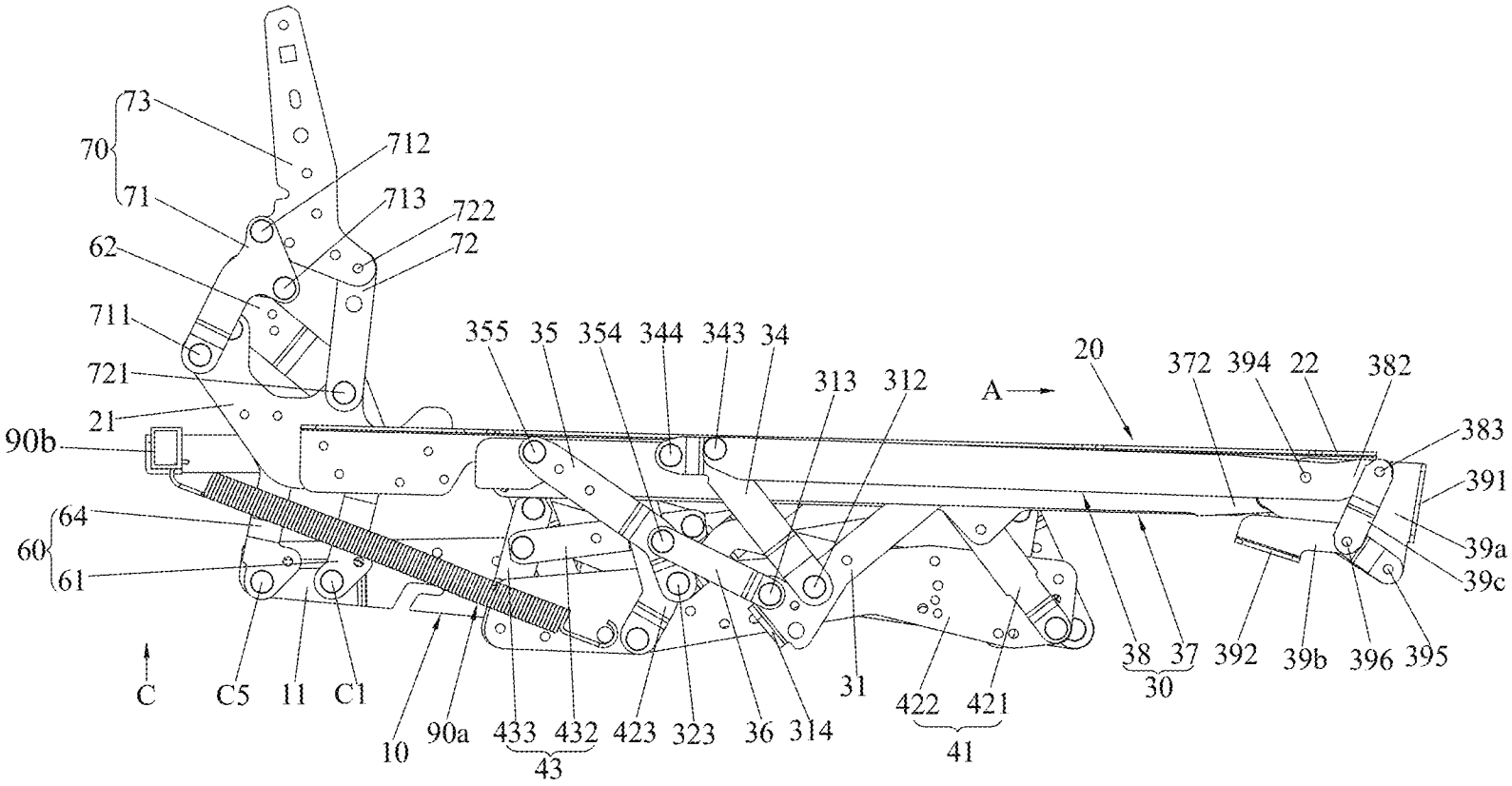
FIG. 6 is a plane view of FIG. 5, with the seat frame at right side, the seat frame control assembly, the linkage arm, the base frame, the backrest device, the backrest control assembly, the extendable actuator, and the front fixed rod hidden.
Figure 7:
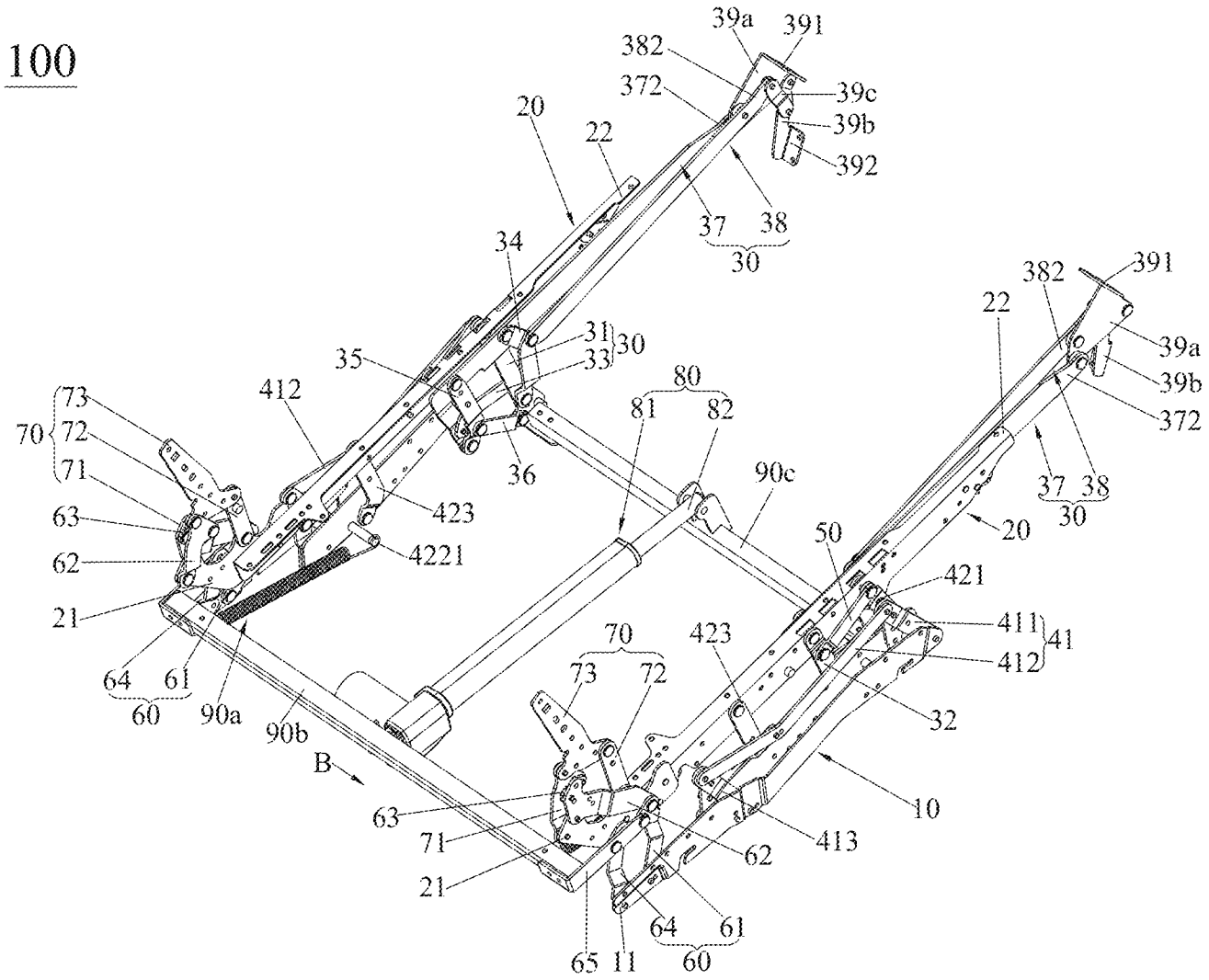
FIG. 7 is a perspective view of the extendable frame for furniture in the first embodiment of the present invention, with the footrest device not yet switched to the extended position and the seat frame not yet switched to the preset intermediate position.
Figure 10:
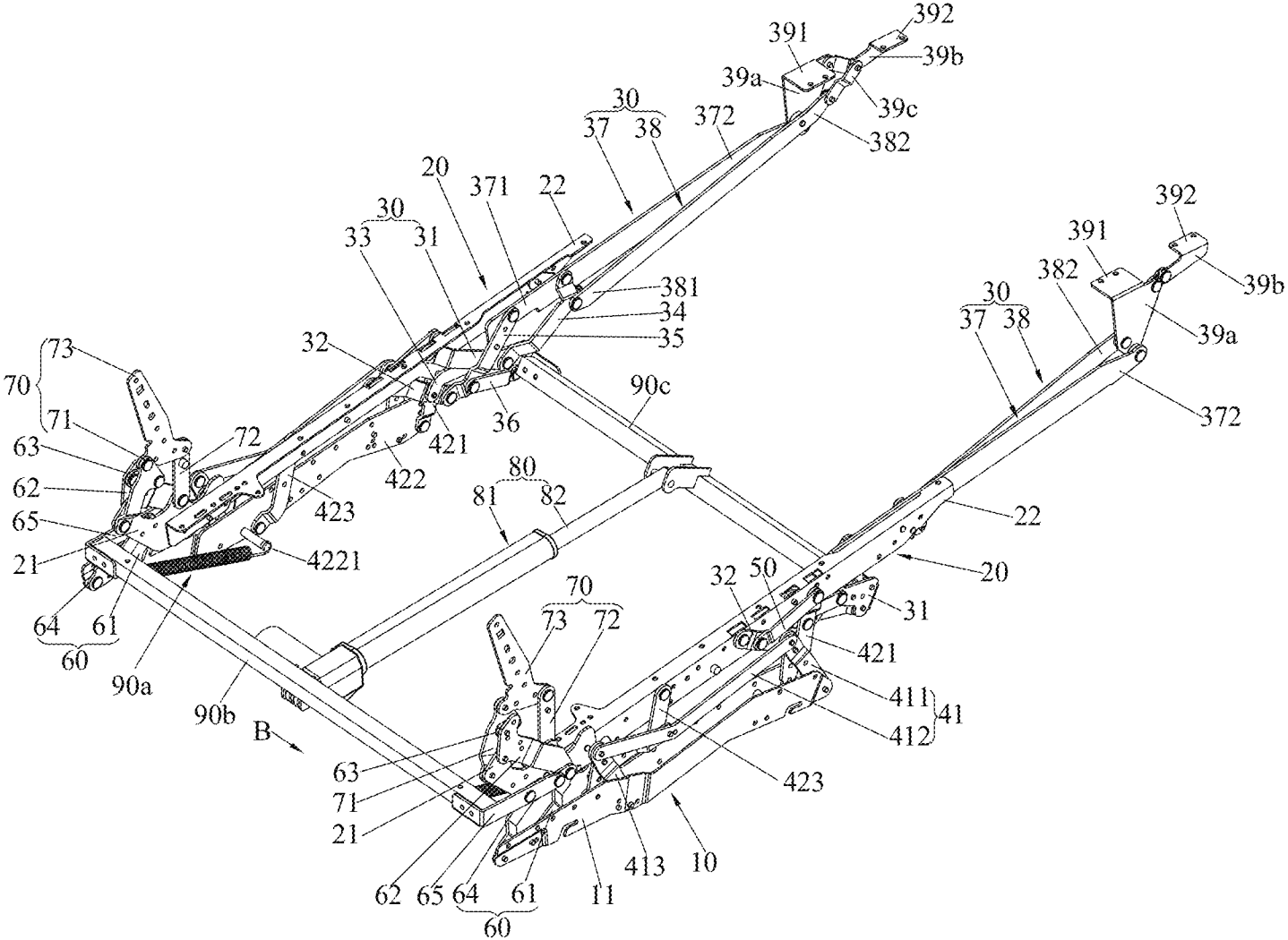
FIG. 10 is a perspective view of the extendable frame for furniture in the first embodiment of the present invention, with the footrest device in the extended position and the seat frame in the preset intermediate position.

Referring to FIGS. 4, 7, and 10, the extendable frame 100 for furniture according to the first embodiment includes a base frame 10, a seat frame 20, a footrest device 30, a seat frame control assembly 40 (referring to FIGS. 15 and 16), a linkage arm 50, a backrest control assembly 60, and a backrest device 70. The seat frame 20 can move relative to the base frame 10 in the front-rear direction, and the seat frame 20 has at least an initial position (referring to FIGS. 4 to 6), a preset intermediate position (referring to FIGS. 10 to 12), and a terminal position (referring to FIGS. 10 to 12) relative to the base frame 10.

The backrest device 70 is assembled at the rear end 21 of the seat frame 20. The rear end 21 of the seat frame 20 provides support and an assembly location for the backrest device 70, which moves together with the seat frame 20 relative to the base frame 10. The footrest device 30 is assembled at the front end 22 of the seat frame 20, which can be switched between a retracted position (as shown in FIGS. 1, and 4 to 6) and an extended position (as shown in FIGS. 2, and 10 to 10), to meet the user's needs. The footrest device 30 includes a front footrest swing arm 31 and a rear footrest swing arm 21 respectively hinged to the seat frame 20. The seat frame control assembly 40 is assembled between the seat frame 20 and the base frame 10 for controlling the movement of the seat frame 20 relative to the base frame 10. The seat frame control assembly 40 includes an outer linkage assembly 41 that is an outer four-bar linkage formed with the base frame 10, an inner linkage assembly 42 (referring to FIG. 10) that is an inner four-bar linkage formed with the seat frame 20, and a transmission assembly 43 (referring to FIGS. 15 and 16) that connects the outer linkage assembly 41 and the inner linkage assembly 42. The inner linkage assembly 42 includes at least a front inner connecting arm 421 and a rear inner connecting arm 423 respectively hinged to the seat frame 20.

Specifically, the head end 50*a* of the linkage arm 50 is hinged to the rear footrest swing arm 32, and the tail end 50*b* of the linkage arm 50 is hinged to the front inner connecting arm 421. This configuration links the footrest device 30 with the inner linkage assembly 42 that controls the movement of the seat frame 20, and allows the extension and retraction of the footrest device 30 to be faster than the forward and backward movement of the seat frame 20 relative to the base frame 10. Clearly, depending on the actual needs, the head end 50*a* of the linkage arm 50 can also be hinged to the front footrest swing arm 31, which is not limited to the arrangement shown in the figures.

The backrest control assembly 60 is hinged to the backrest device 70, the rear end 11 of the base frame 10, and the rear end 21 of the seat frame 20, respectively, and moves with the seat frame 20. That is, during the movement of the seat frame 20, it also drives the backrest control assembly 60 to move relative to the base frame 10.

Based on these configurations, during the process of switching from the retracted position to the extended position, the footrest device 30 drives the seat frame control assembly 40 through the linkage arm 50, causing the seat frame 20 together with the backrest device 70 to switch from the initial position shown in FIG. 1 to the preset intermediate position shown in FIG. 2. Specifically, the forward movement of the seat frame 20 is slower than the extension of the footrest device 30. As the backrest device 70 follows the seat frame 20 from the preset intermediate position in FIG. 2 to the terminal position shown in FIG. 3, the backrest control assembly 60 controls the backrest device 70 for adjusting the angle of the backrest 200 mounted on the backrest device 70. Furthermore, in the process of switching the seat frame 20 between the initial position and the terminal position, the head end 50*a* of the linkage arm 50 remains in front of the tail end 50*b*, so that the linkage arm 50 is kept in an inclined position, as shown the inclination arrangement in FIGS. 5, 8, 11, and 13.

It should be noted that during the process of switching the sofa 1000 from the seated position (also called as closed mode) to the fully reclined position (also called as relaxed mode), when the footrest device 30 is switched from the retracted position to the extended position, the linkage arm 50 drives the seat frame control assembly 40, causing the seat frame 20 to switch from the initial position to the preset intermediate position, so that the sofa 1000 is in the reclining position (also called as TV watching mode). When the sofa 1000 is in the reclining position, continuing to move the seat frame 20 from the preset intermediate position to the terminal position causes the backrest control assembly 60 to move the backrest device 70, thereby adjusting the angle of the backrest 200 and achieving the switching of the sofa 1000 from the reclining position to the fully reclined position.

Figure 13:
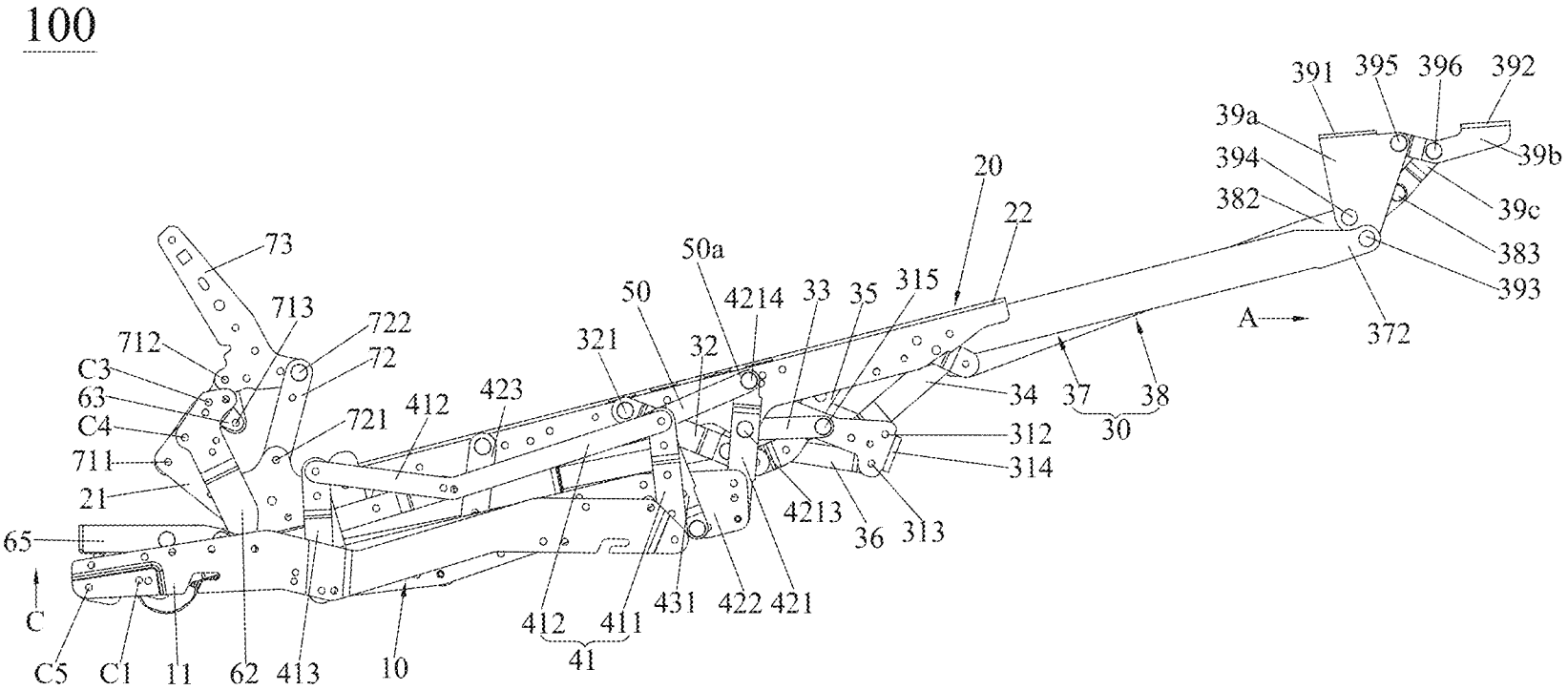
FIG. 13 is a plane view of FIG. 11 showing the seat frame in a certain intermediate position as it moves towards the terminal position.
Figure 14:
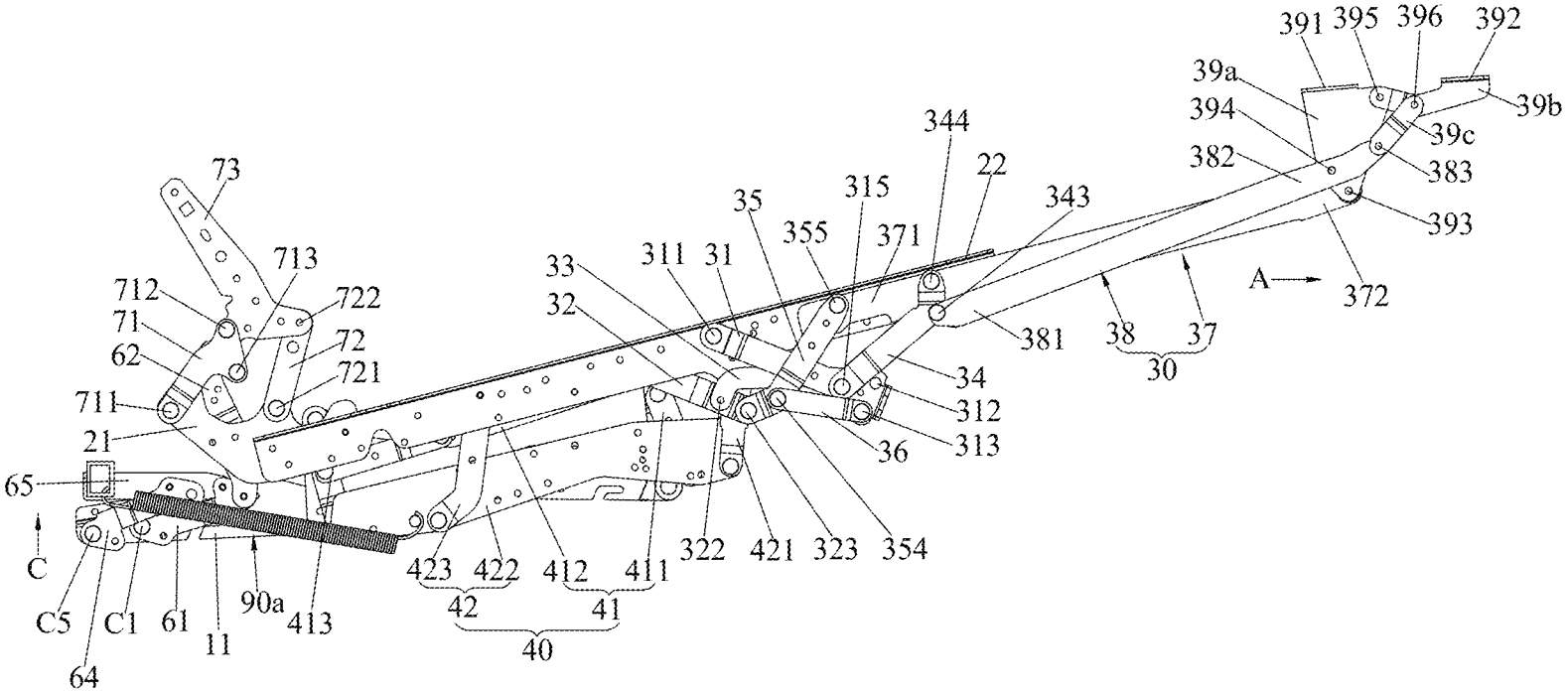
FIG. 14 is a plane view of FIG. 13, with the seat frame at right side, the seat frame control assembly, the linkage arm, the base frame, the backrest device, the backrest control assembly, the extendable actuator, and the front fixed rod hidden.

More specifically, as shown in FIG. 14, in the left-right direction of the base frame 20, the inner linkage assembly 42 is located on the first side of the seat frame 20 (e.g., the inner side shown in FIG. 14), while the footrest device 30 is located on the second side of the seat frame 20 (e.g., the outer side shown in FIG. 14). At this point, the rear footrest swing arm 32 hinged to the linkage arm 50 extends from below the seat frame 20 over to its first side and upwards. Specifically, in FIGS. 5 and 11, as an embodiment, the rear footrest swing arm 32 is provided with a first pivot 321 for hinging with the seat frame 20 and a second hinge point 324 for hinging with the linkage arm 50, with the first pivot 321 located above the second hinge point 324. The front inner connecting arm 421 has a third hinge point 4213 for hinging with the seat frame 20 and a fourth hinge point 4214 for hinging with the linkage arm 50, with the fourth hinge point 4214 positioned above the third hinge point 4213 and the third hinge point 4213 positioned in front of the first pivot 321. This allows the linkage arm 50 to maintain an inclined state throughout the transition of the seat frame 20 from the initial position to the terminal position. Additionally, as illustrated in FIGS. 5, 8, 11, 13, and 16, the linkage arm 50 is arranged at an angle relative to the seat frame 20. This means that whether the sofa 1000 is in the seated position (closed mode), reclining position (TV watching mode), or fully reclined position (relaxed mode), the linkage arm 50 can remain inclined relative to the seat frame 20, as shown in the forward-up, backward-down inclined configuration in FIGS. 5, 8, 11, 13, and 16, thereby controlling that the extension of the footrest device 30 is faster than the front-back movement of the seat frame 20 with respect to the base frame 10.

Figure 15:
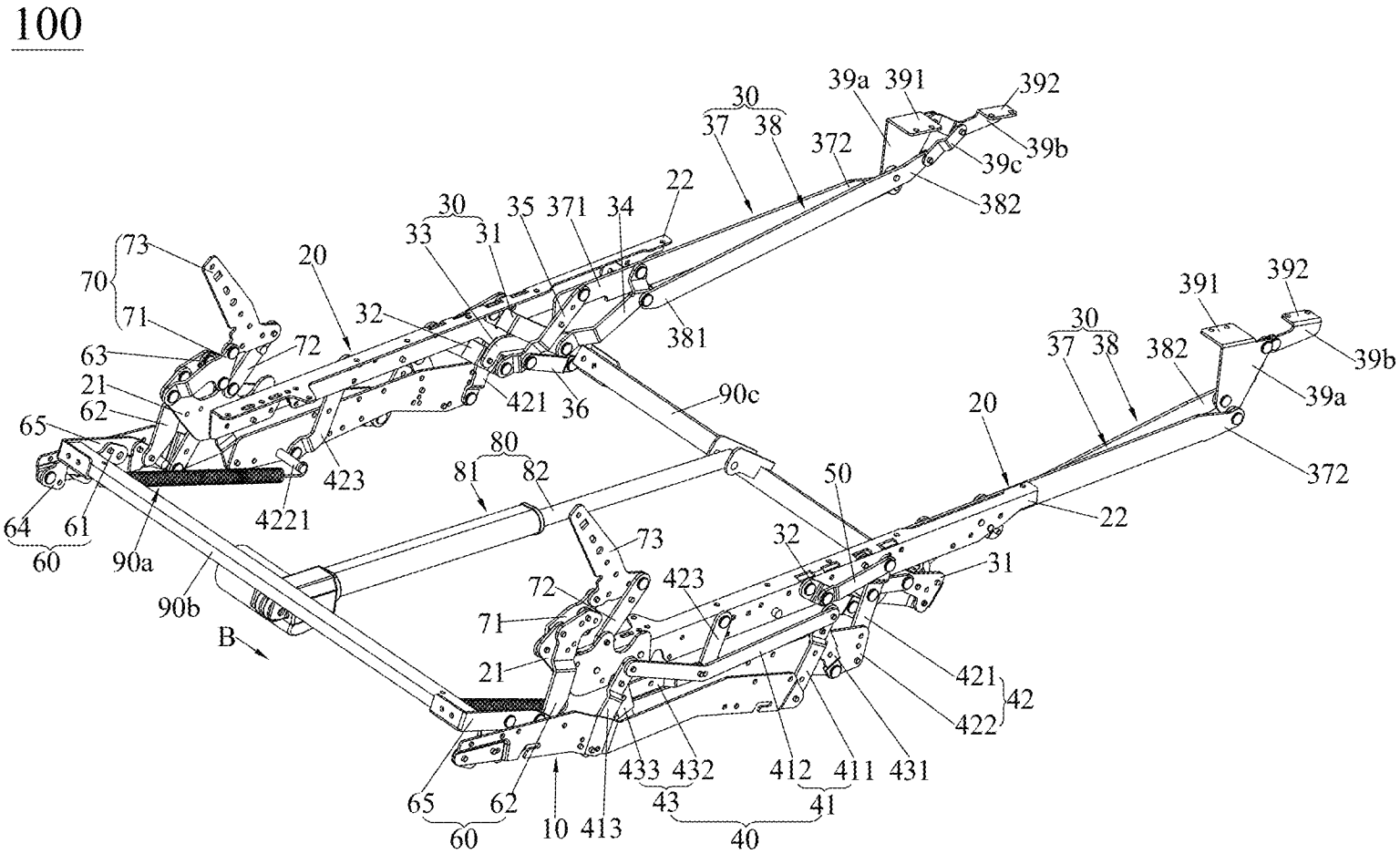
FIG. 15 is a perspective view of the extendable frame for furniture in the first embodiment of the present invention, with the seat frame switched to the terminal position.
Figure 17:
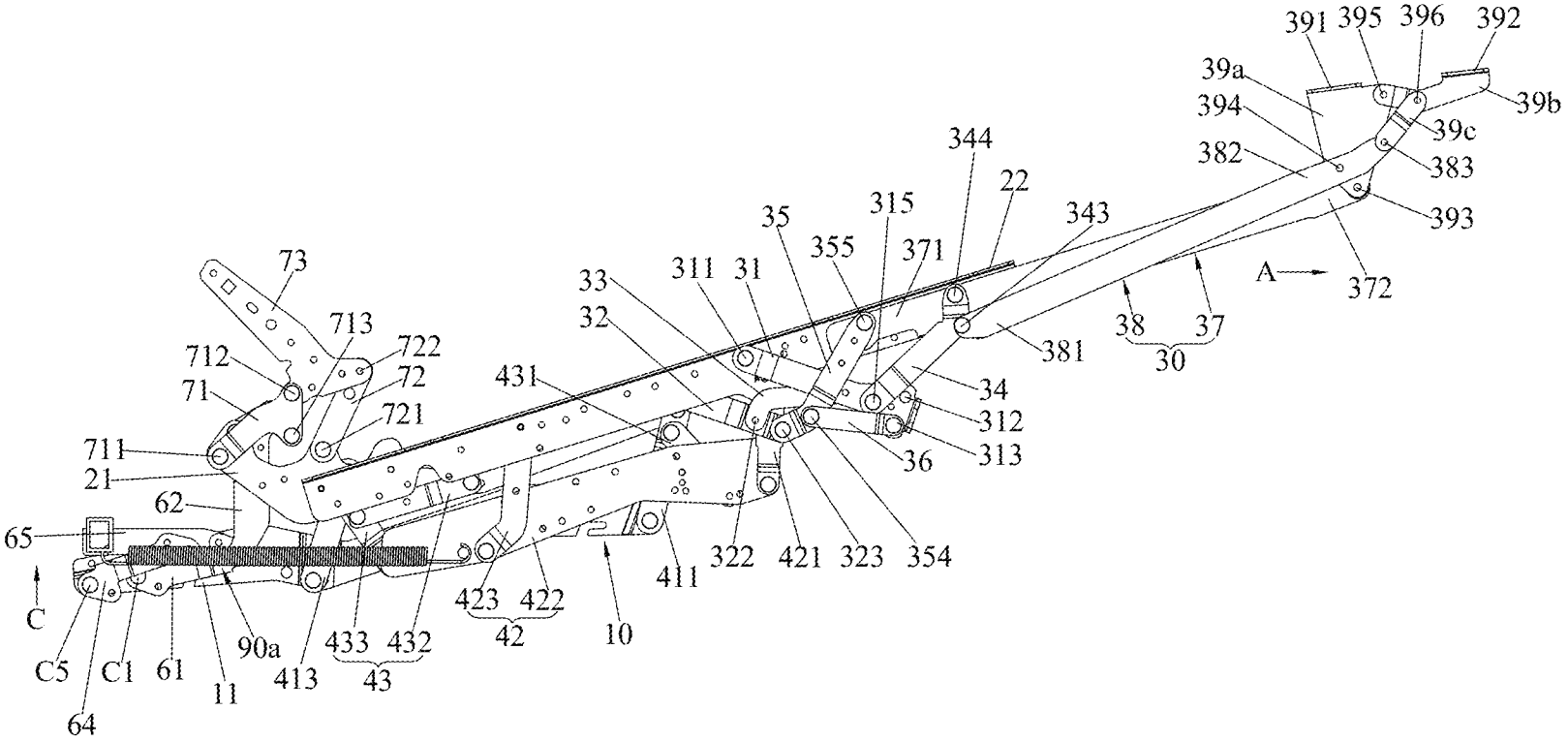
FIG. 17 is a plane view of FIG. 16, with the seat frame at right side, the seat frame control assembly, the linkage arm, the base frame, the backrest device, the backrest control assembly, the extendable actuator, and the front fixed rod hidden.
Figure 18:
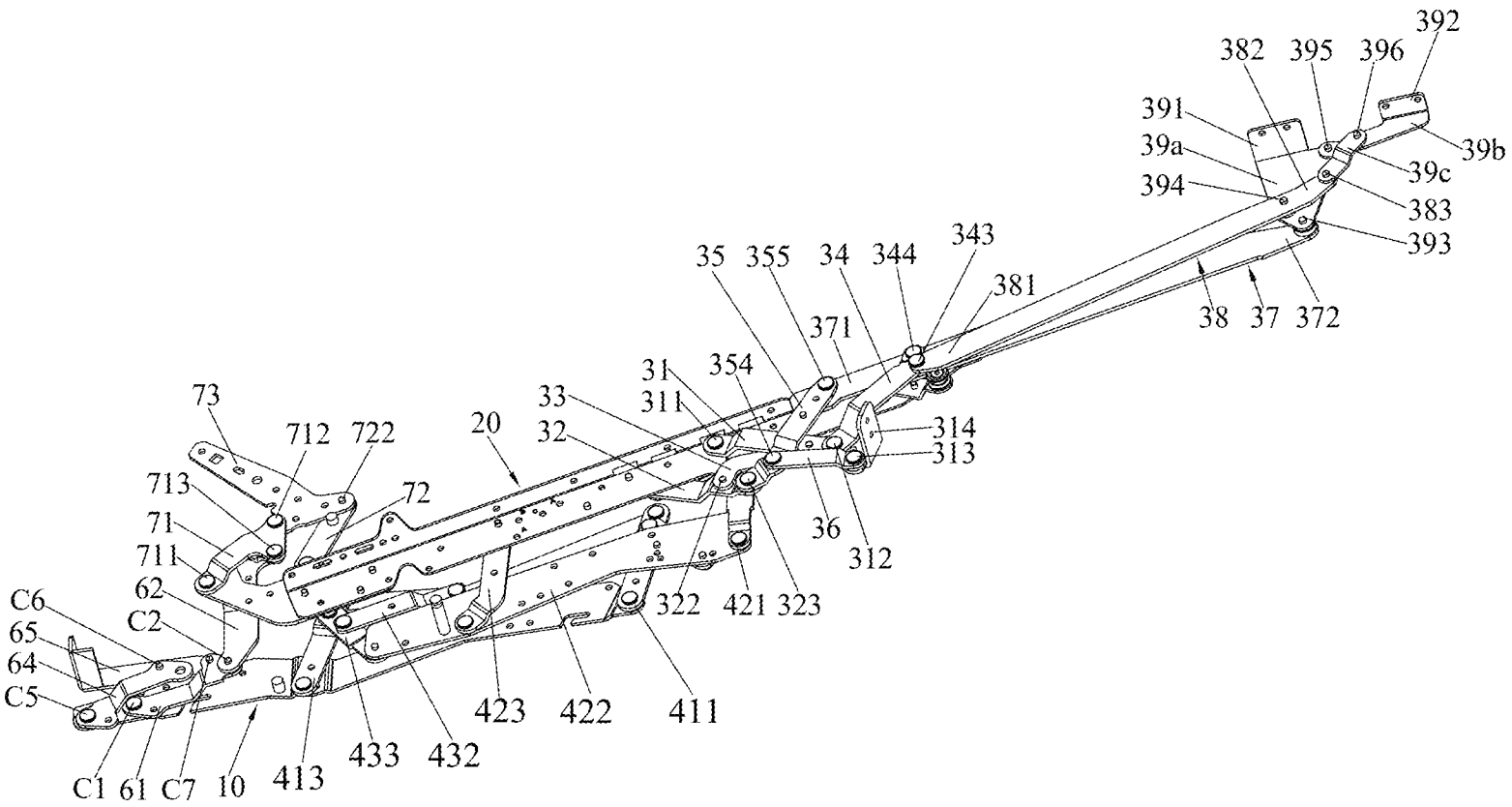
FIG. 18 is a perspective view of FIG. 5, showing the seat frame at right side, the seat frame control assembly, the linkage arm, the base frame, the backrest device, and the backrest control assembly.

As shown in FIGS. 12, 14, 15, and 17 to 20, as an embodiment, the footrest device 30 further includes a front footrest connecting arm 34, a rear footrest connecting arm 35, a second intermediate connecting arm 36, a first long connecting arm 27 and a second long connecting arm 38 extended in the front-rear direction of the base frame 10. As an option, as shown in FIGS. 6 and 14, the first long connecting arm 37 is longer than the second long connecting arm 38. The first long connecting arm 37 and the second long connecting arm 38 are arranged side by side in the left-right direction of the seat frame 20, so that the first long connecting arm 37 is located between the seat frame 20 and the second long connecting arm 38, as shown in FIG. 15. The upper end of the rear footrest connecting arm 35 is hinged to the rear end 371 of the first long connecting arm 37, and the lower end of the rear footrest connecting arm 35 is hinged to the rear footrest swing arm 32. The lower end of the front footrest connecting arm 34 is hinged to the front footrest swing arm 31, and the upper end of the front footrest connecting arm 34 is sequentially hinged to the rear end 381 of the second long connecting arm 38 and the rear end 371 of the first long connecting arm 37. The second intermediate connecting arm 36 is hinged to both the rear footrest connecting arm 35 and the front footrest swing arm 31, as shown in FIG. 17, so that the second intermediate connecting arm 36 and the rear footrest connecting arm 35 together drive the first long connecting arm 37 at a speed greater than a speed of driving the second long connecting arm 38 by the front footrest connecting arm 34, thus a speed difference between the first long connecting arm 37 and the second long connecting arm 38 is obtained.

Furthermore, the front end of the first long connecting arm 37 is hinged to a first footrest head 39*a* which has a support portion 391. The position of the first footrest head 39*a*, away from the first long connecting arm 37, is hinged to a second footrest head 39*b* which has a support portion 392. The second footrest head 39*b* is hinged to a short arm 39*c*, and the front end 382 of the second long connecting arm 38 is hinged sequentially with the first footrest head 39*a* and the short arm 39*c*.

Specifically, as shown in FIGS. 6, 9, 11-14, and 17, for an embodiment, the first footrest head 39*a* is provided with a first hinge structure 393 that is hinged to the front end 372 of the first long connecting arm 37, a second hinge structure 394 that is hinged to the front end 382 of the second long connecting arm 38, and a third hinge structure 395 that is hinged to the second footrest head 39*b*. The second hinge structure 394 is adjacent to the first hinge structure 393. The front end 382 of the second long connecting arm 38 is provided with a fourth hinge structure 383, which is located in front of the second hinge structure 394. The second footrest head 39*b* is provided with a fifth hinge structure 396, located between the third hinge structure 395 and the support portion 392 of the second footrest head 39*b*. The short arm 39*c* is hinged to both the fourth hinge structure 383 and the fifth hinge structure 396.

Figure 11:
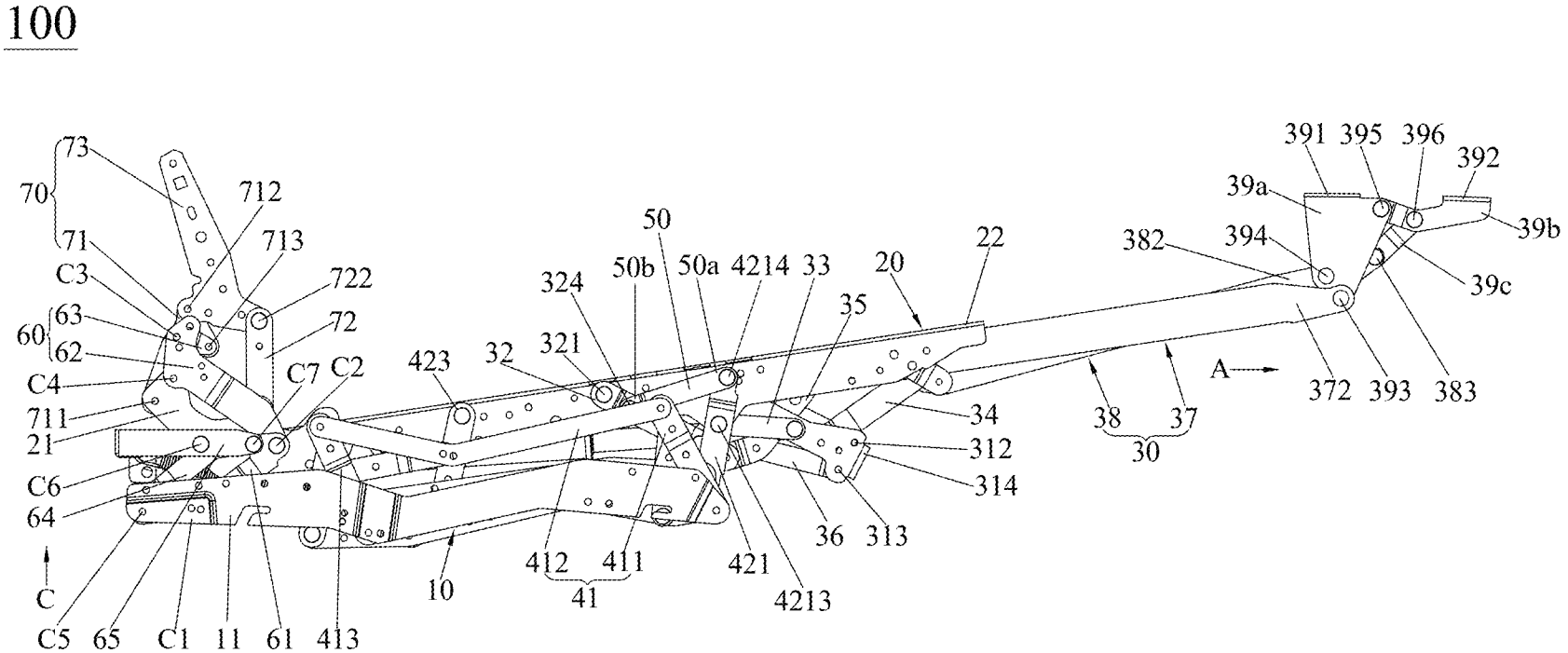
FIG. 11 is a plane view of FIG. 10 viewed in the opposite direction of arrow B.

As an option, the distance from the second hinge structure 394 to the third hinge structure 395 is D1, the distance from the third hinge structure 395 to the fifth hinge structure 396 is D2, the distance from the fifth hinge structure 396 to the fourth hinge structure 383 is D3, and the distance from the fourth hinge structure 383 to the second hinge structure 394 is D4, where D1>D3>D4>D2. The purpose of this arrangement is that when the footrest device 30 is switched to the retracted position shown in FIG. 6, the support portion 391 of the first footrest head 39*a* is arranged forward, and the support portion 392 of the second footrest head 39*b* is arranged downward. This arrangement can prevent the first and second footrest heads 39*a* and 39*b* from protruding beyond the seat frame 20 in this position, as shown in FIGS. 1 and 6. When the footrest device 30 is switched to the extended position shown in FIG. 11, the support portions 391 and 392 of the first and second footrest heads 39*a* and 39*b* are arranged upward, for foot resting, as shown in FIGS. 2 and 11. Moreover, due to the arrangement of D1>D3>D4>D2, the space required for switching the support portion 391 of the first footrest head 39*a* between the forward and upward positions, and the space required for switching the support portion 392 of the second footrest head 39*b* between the downward and upward positions can be reduced. This ensures that the foot supports 500 mounted on the support portions 391 and 392 will not collide with the front support frame 600 during the position switch.

As shown in FIGS. 14, 16, and 17 to 20, as an embodiment, the front footrest swing arm 31 is provided with a first upper hinge point 311, a first lower hinge point 312, a first intermediate hinge point 315 located between the first upper hinge point 311 and the first lower hinge point 312, and an undermost hinge point 313 located below the first lower hinge point 312. The lower end of the rear footrest swing arm 32 is provided with a second intermediate hinge point 322 and a second lower hinge point 323. The seat frame 20 is hinged to the first upper hinge point 311, while the front footrest connecting arm 34 is hinged to the first lower hinge point 312. The first intermediate connecting arm 33 is hinged to the first intermediate hinge point 315 and the second intermediate hinge point 322, respectively. In such a way, the first intermediate connecting arm 33, the front footrest connecting arm 34, and the front footrest swing arm 31 are hinged uncoaxially, and the first intermediate connecting arm 33, the rear footrest connecting arm 35, and the rear footrest swing arm 31 are also hinged uncoaxially.

Additionally, as shown in FIGS. 14, 17 to 20, as an embodiment, the rear footrest connecting arm 35 is provided with a third intermediate hinge point 354 and a third upper hinge point 355 hinged to the rear end 371 of the first long connecting arm 37. The second intermediate connecting arm 36 is hinged to both the undermost hinge point 313 and the third intermediate hinge point 354, respectively. The third intermediate hinge point 354 is located between the second lower hinge point 323 and the third upper hinge point 355. As an option, the lower end of the rear footrest connecting arm 35 may be configured as a bending structure that is bent rearward, with the third intermediate hinge point 354 located at the bending structure. In such a way, the sliding speed of the first long connecting arm 37, driven by the four-bar linkage formed by the seat frame 20, the front footrest swing arm 31, the rear footrest swing arm 32, and the first intermediate connecting arm 33, can be faster than that of the second long connecting arm 38. As a result, the first long connecting arm 37 can slide relative to the second long connecting arm 38.

Furthermore, as shown in FIGS. 14, 17 to 20, as an embodiment, the front footrest connecting arm 34 is further provided with a fourth intermediate hinge point 343 and a fourth upper hinge point 344. The rear end 382 of the second long connecting arm 38 is hinged to the fourth intermediate hinge point 343 of the front footrest connecting arm 34, while the first long connecting arm 37 is hinged to the fourth upper hinge point 344 of the front footrest connecting arm 34. Optionally, as an embodiment, the upper end of the front footrest connecting arm 34 is a bending structure that is bent forward, and the fourth intermediate hinge point 343 of the front footrest connecting arm 34 is located at the bending structure. In such a way, the first long connecting arm 37 and the second long connecting arm 38 can be fit tightly, and the first long connecting arm 37 can slide relative to the second long connecting arm 38 reliably as the footrest device 30 is switched between the extended and retracted positions, thereby allowing the support portion 391 of the first footrest head 39*a* to rotate between the forward and upward positions.

Figure 9:
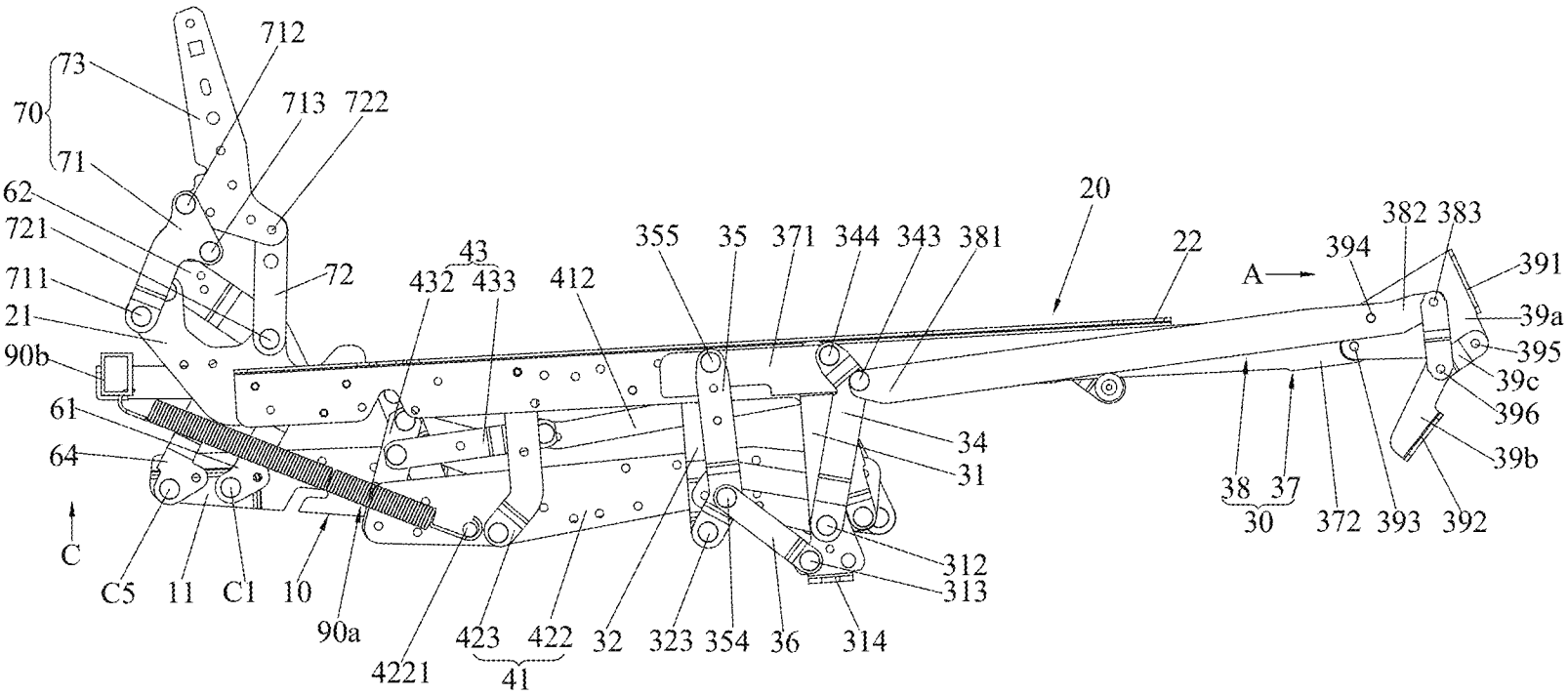
FIG. 9 is a plane view of FIG. 8, with the seat frame at right side, the seat frame control assembly, the linkage arm, the base frame, the backrest device, the backrest control assembly, the extendable actuator, and the front fixed rod hidden.
Figure 12:
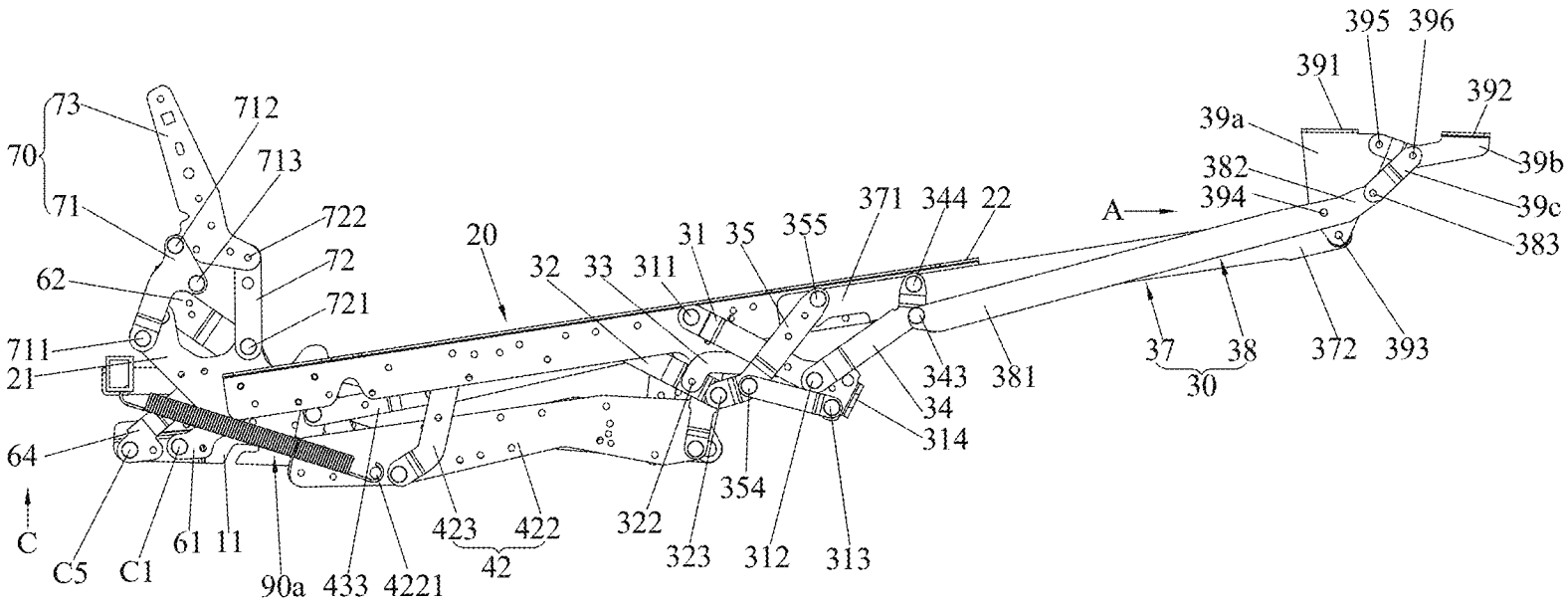
FIG. 12 is a plane view of FIG. 11, with the seat frame at right side, the seat frame control assembly, the linkage arm, the base frame, the backrest device, the backrest control assembly, the extendable actuator, and the front fixed rod hidden.

Further referring to FIGS. 6, 9 and 12, the working principle of the footrest device 30 is explained. When switching the footrest device 30 from the retracted position shown in FIG. 6 to the extended position shown in FIG. 12, the front footrest swing arm 31 rotates counterclockwise around the first upper hinge point 311, and the rear footrest swing arm 32 rotates counterclockwise around the first pivot 321, thereby driving the first intermediate connecting arm 33 to move upward, while also driving the front footrest connecting arm 34 to swing clockwise around the first lower hinge point 312, and driving the rear footrest connecting arm 35 to swing clockwise around the second lower hinge point 323, and also driving the second intermediate connecting arm 36 to rotate clockwise. As a result, the first long connecting arm 37 and the second long connecting arm 38 slide forward, with the sliding speed of the first long connecting arm 37 being greater than that of the second long connecting arm 38. Due to the forward sliding of the first and second long connecting arms 37 and 38, the first footrest head 39*a*, the second footrest head 39*b*, and the short arm 39*c* thus rotate counterclockwise. When the front footrest swing arm 31 rotates counterclockwise around the first upper hinge 311 and the rear footrest swing arm 32 rotates counterclockwise around the first upper hinge 321 to the position shown in FIG. 12, the support portion 391 of the first footrest head 39*a* and the support portion 392 of the second footrest head 39*b* are precisely positioned in the upward-facing position, as shown in FIG. 12. It should be noted that, FIG. 9 shows an intermediate position during the transition from the retracted position to the extended position. The process of switching the footrest device 30 from the retracted position to the extended position is exactly the opposite of the process from the extended position back to the retracted position, which is not described further here. It's seen that, due to theses configurations of the footrest device 30, space usage in the vertical direction of the seat frame 20 is minimized.

As shown in FIGS. 17 to 20, the inner linkage assembly 42 further includes an inner intermediate connecting arm 422 extended in the front-rear direction of the base frame 10 and is arranged below the seat frame 20. The inner intermediate connecting arm 422 is hinged to the front inner connecting arm 421 and rear inner connecting arm 423 respectively, thereby allowing the front inner connecting arm 421 to drive the seat frame 20 forward by pulling the inner connecting arm 422 and rear inner connecting arm 423.

Figure 19:
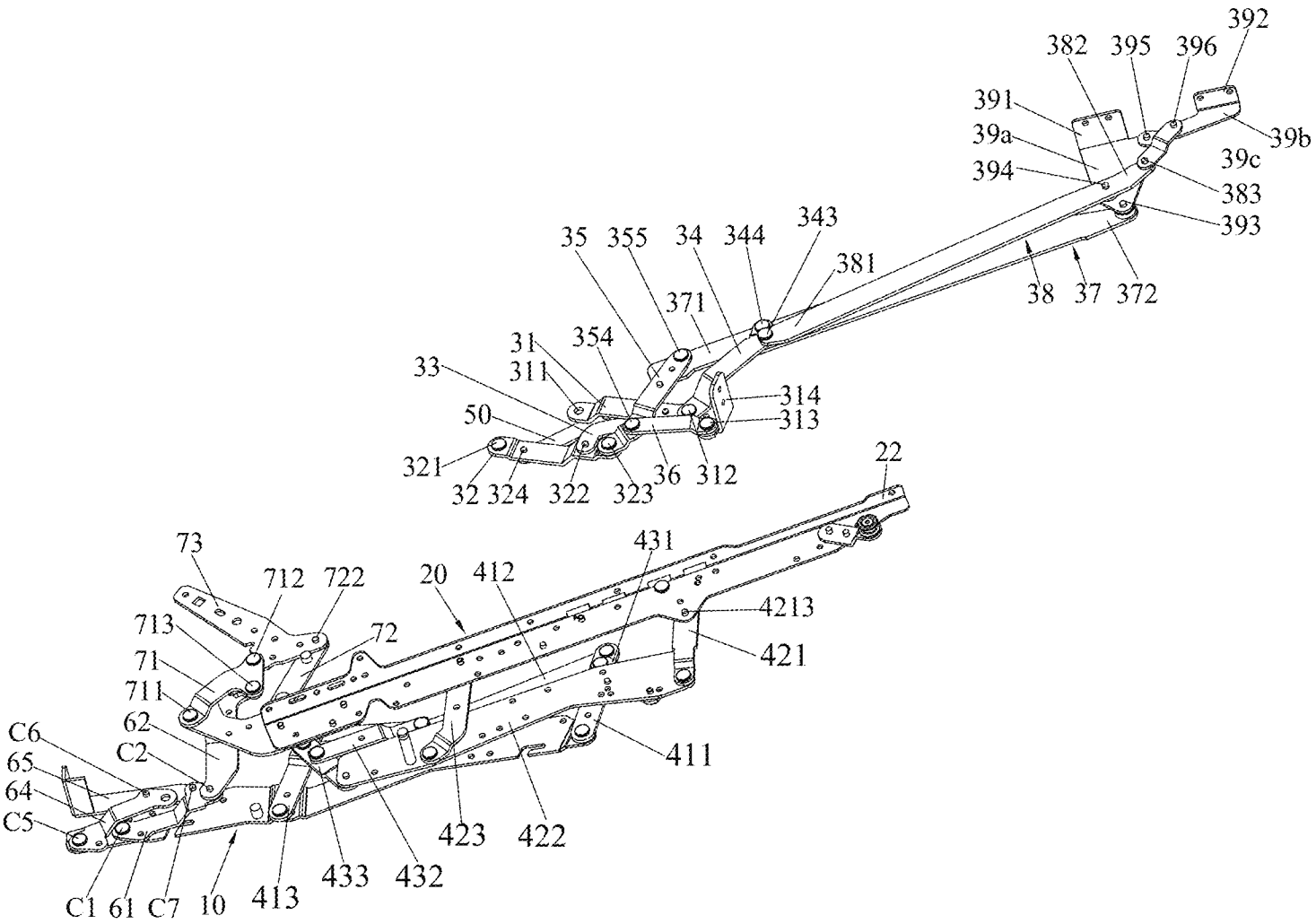
FIG. 19 is an exploded perspective view of FIG. 18.
Figure 20:
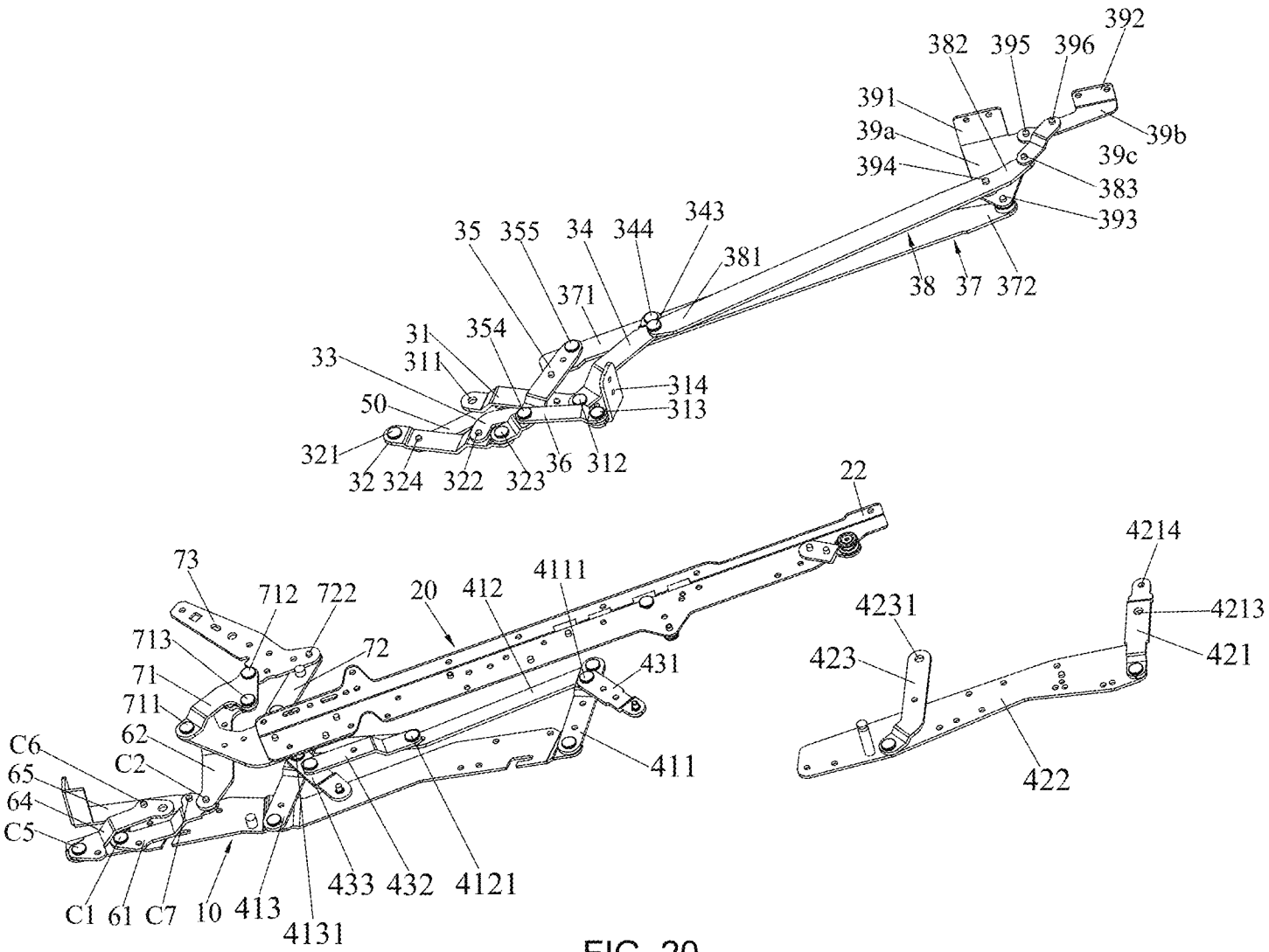
FIG. 20 is a further exploded perspective view of FIG. 19.

As shown, the outer linkage assembly 41 includes an front outer connecting arm 411, an outer intermediate connecting arm 412, and an rear outer connecting arm 413. The outer intermediate connecting arm 412 extends along the front-rear direction of the base frame 10 and is located above the base frame 10. The front outer connecting arm 411 and the rear outer connecting arm 413 are respectively hinged to both the base frame 10 and the outer intermediate connecting arm 412. The transmission assembly 43 includes a front transmission arm 431, an intermediate transmission arm 432, and a rear transmission arm 433. The front transmission arm 431 is hinged to both the inner intermediate connecting arm 422 and the front outer connecting arm 411, the rear transmission arm 433 is hinged to both the rear outer connecting arm 413 and the inner intermediate connecting arm 422, and the intermediate transmission arm 432 is hinged to both the middle part of the outer intermediate connecting arm 412 and rear transmission arm 433. Therefore, the inner linkage assembly 42, which forms the inner four-bar linkage with the seat frame 20, and the outer linkage assembly 41, which forms the outer four-bar linkage with the base frame 10, are interconnected through the front transmission arm 431, the intermediate transmission arm 432, and the rear transmission arm 433, thereby ensuring the sequential movement of the inner and outer linkage assemblies 42 and 41. Specifically, as an embodiment in FIGS. 19 and 20, the front outer connecting arm 411 has a hinge point 4111 for hinging with the front transmission arm 431, the outer intermediate connecting arm 412 has a hinge point 4121 for hinging with the intermediate transmission arm 432, and the rear outer connecting arm 413 has a hinge point 4131 for hinging with the rear transmission arm 433, as shown in FIGS. 19 and 20.

Figure 5:
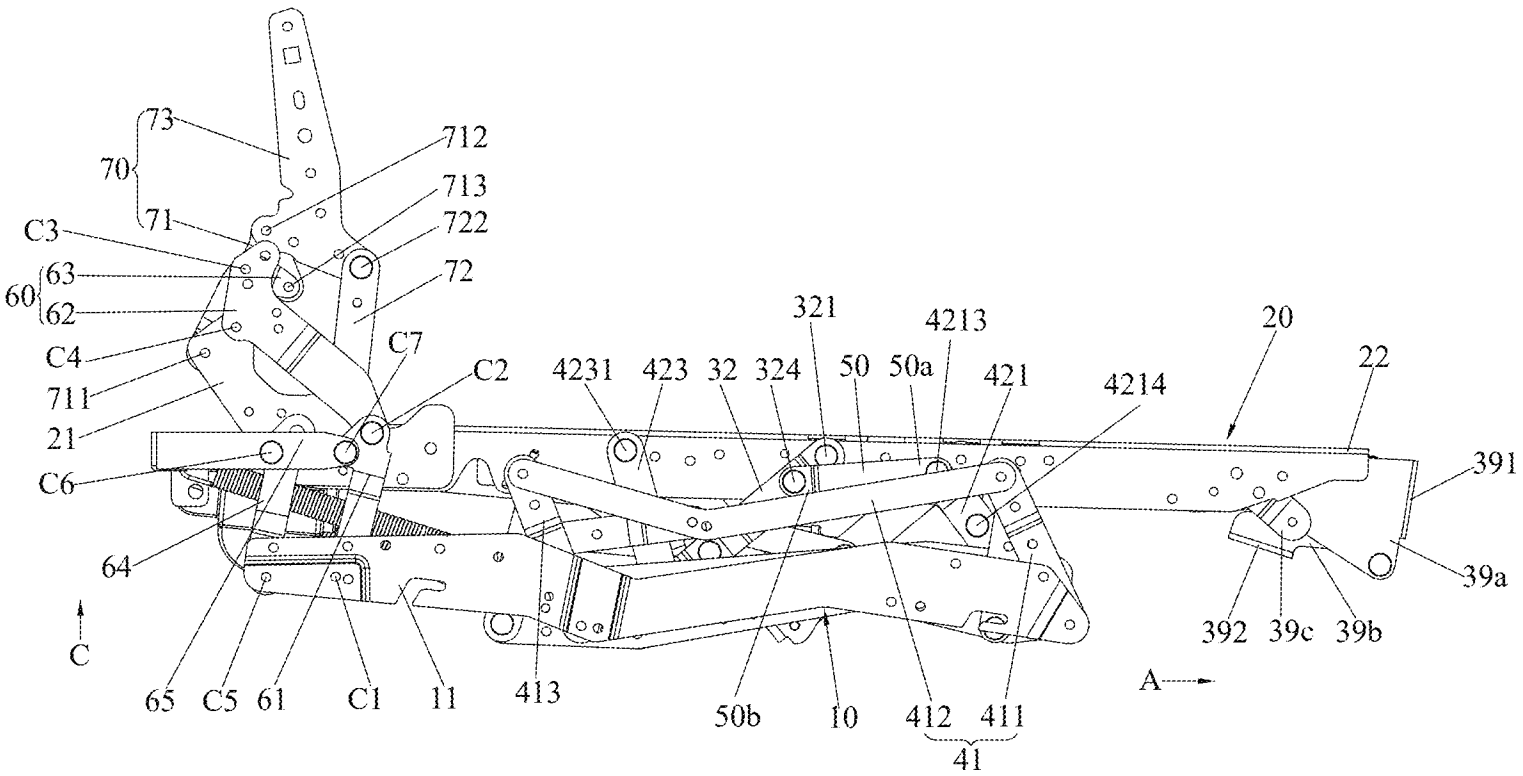
FIG. 5 is a plane view of FIG. 4 viewed in the opposite direction of arrow B.

As shown in FIGS. 4 to 20, as an embodiment, the backrest device 70 includes a rear backrest swing arm 71, a front backrest swing arm 72, and a backrest rotating frame 73, which allows the backrest 200 to be assembled and adjusted in angle by rotating. The rear backrest swing arm 71 has a first hinge point 711 hinged to the rear end 21 of the seat frame 20, a second hinge point 712 hinged to the backrest rotating frame 73, and a third hinge point 713 hinged to the tail end of the second control connecting arm 63 described below. The third hinge point 713 is positioned below the second hinge point 712, as shown in FIGS. 5 and 6. The front backrest swing arm 72 has a fourth hinge point 721 hinged to the rear end 21 of the seat frame 20, and a fifth hinge point 722 hinged to the backrest rotating frame 73. The fifth hinge point 722 is located above the fourth hinge point 721 and in front of the second hinge point 712. The fourth hinge point 721 is positioned in front of the first hinge point 711. Optionally, as an embodiment, the distance from the second hinge point 712 to the first hinge point 711 is P5, the distance from the fourth hinge point 721 to the fifth hinge point 722 is P6, the distance from the first hinge point 711 to the fourth hinge point 721 is P7, and the distance from the second hinge point 712 to the fifth hinge point 722 is P8, where P7>P5>P6>P8. In such a way, a trapezoidal four-bar linkage is formed by the seat frame 20, the rear backrest swing arm 71, the front backrest swing arm 72, and the backrest rotating frame 73, thereby allowing the backrest rotating frame 73 to rotate at a greater angle under the drive of the rear backrest swing arm 71.

As shown in FIGS. 4 to 8, 10, 11, 13, 15 and 16, as an embodiment, the backrest control assembly 60 includes a first control swing arm 61, a first control connecting arm 62, and a second control connecting arm 63. The lower end of the first control swing arm 61 is hinged to the rear end 11 of the base frame 10 to form a first hinge centerline C1. The upper end of the first control swing arm 61 is hinged to the lower end of the first control connecting arm 62 to form a second hinge centerline C2. The upper end of the first control connecting arm 62 is hinged to the head end of the second control connecting arm 63 to form a third hinge centerline C3. The first control connecting arm 62 is also hinged to the rear end 21 of the seat frame 20 to form a fourth hinge centerline C4. The tail end of the second control connecting arm 63 is hinged to the backrest device 70 (specifically the third hinge point 713).

In such a way, the backrest control assembly 60 drives the rear backrest swing arm 71 into a pivoting motion when the seat frame 20 and backrest device 70 move forward relative to the base frame 10 to the preset intermediate position, as shown in FIG. 11. Furthermore, as shown in FIGS. 1 to 3, during the adjustment process, the backrest 200 mounted on the backrest rotating frame 73 rotates almost around the same axis relative to the seat cushion 300 mounted on the seat frame 20, which will not stretch the user's clothing.

As shown in FIG. 5, the distance from the first hinge centerline C1 to the second hinge centerline C2 is P1, the distance from the second hinge centerline C2 to the fourth hinge centerline C4 is P2, the distance from the fourth hinge centerline C4 to the third hinge centerline C3 is P3, and the distance from the third hinge centerline C3 to the third hinge point 713 is P4. Moreover, P2>P1>P7>P5>P6>P8>P3>P4. Under such arrangement, it's ensured that the backrest control assembly 60 effectively controls the rear backrest device 70 to adjust the angle only when the seat frame 20 and the backrest device 70 move together to the preset intermediate position.

Figure 8:
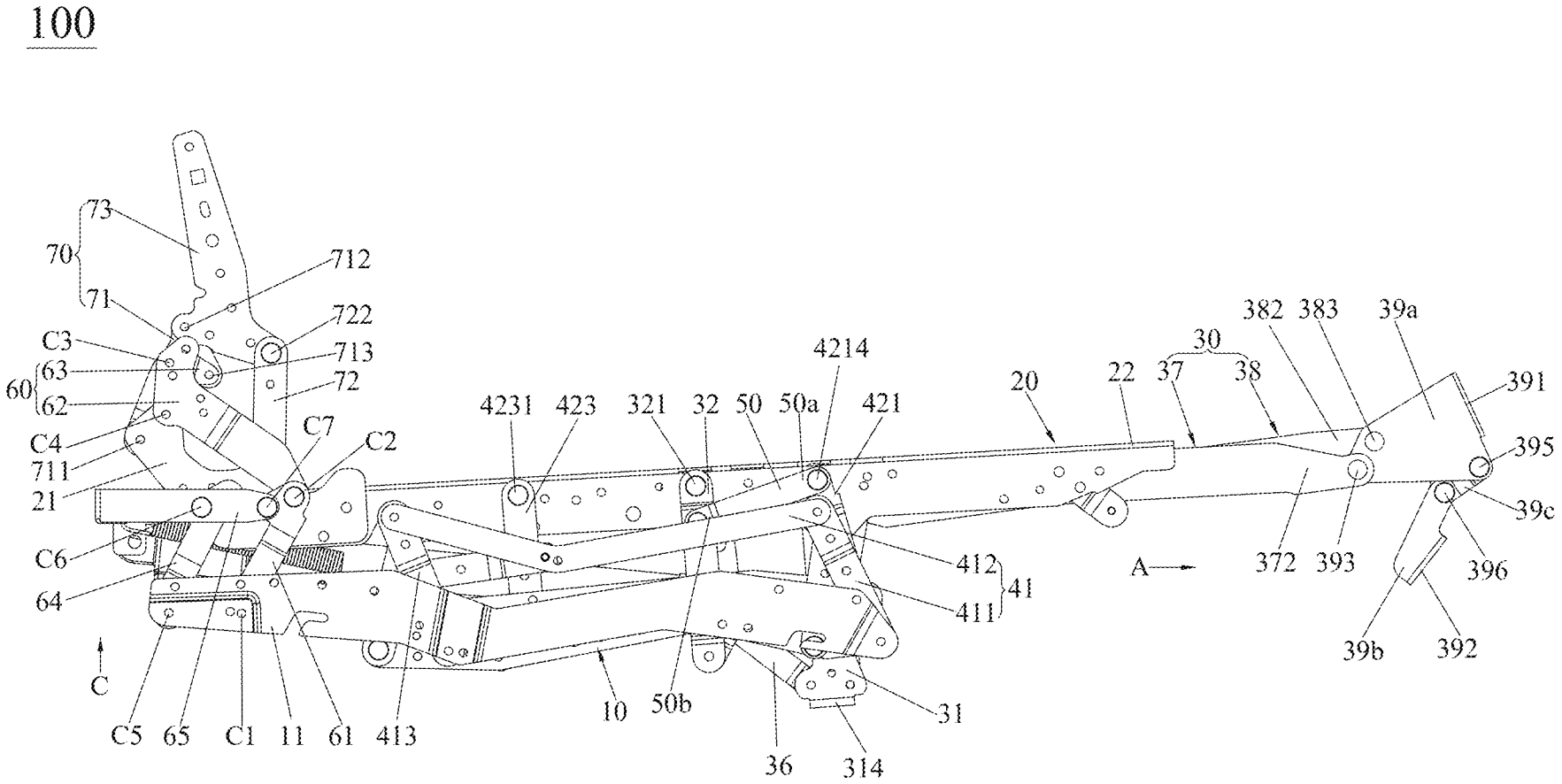
FIG. 8 is a plane view of FIG. 7 viewed in the opposite direction of arrow B.

Additionally, as shown in FIGS. 5, 8, and 11, as an embodiment, the backrest control assembly 60 further includes a second control swing arm 64 located behind the first control swing arm 61 and an intermediate control connecting arm 65 extending in the front-rear direction of the base frame 10. The lower end of the second control swing arm 64 is hinged to the rear end 11 of the base frame 10 to form a fifth hinge centerline C5. The upper end of the second control swing arm 64 is hinged to the intermediate control connecting arm 65 to form a sixth hinge centerline C6. The intermediate control connecting arm 65 is hinged to the upper end of the first control swing arm 61 to form a seventh hinge centerline C7 behind the second hinge centerline C2. Additionally, a rear fixed rod 90*b* extending in the left-right direction of the base frame 10 is connected to the intermediate control connecting arm 65 at a position behind the sixth hinge centerline C6. With this four-linkage mechanism composed of the first control swing arm 61, second control swing arm 64, intermediate control connecting arm 65, and the base frame 10, the rear position of the rear fixed rod 90*b* relative to the rear end 11 of the base frame 10 is shortened, thereby allowing more designs for the sofa 1000. Furthermore, this configuration also reduces the minimum installation distance of the telescopic actuator 80, resulting in a shorter stroke of the telescopic actuator 80, thereby enabling a faster extension speed of the expandable frame 100 for furniture in the first embodiment, even with limited actuator speed.

As shown in FIGS. 4, 7, 10, and 15, as an embodiment, the expandable frame 100 for furniture in the first embodiment further includes a telescopic actuator 80 and a spring 90*a*. The telescopic actuator 80 includes an actuator body 81 and a telescopic body 82 that slides telescopically on the actuator body 81. A front fixed rod 90*c* extending in the left-right direction of the base frame 10 is fixed on the front footrest swing arm 31, as shown in FIGS. 4, 7, 10, and 15. Clearly, if necessary, the front fixed rod 90*c* could also be fixed on the rear footrest swing arm 32, which is not limited to the arrangement shown in FIGS. 4, 7, 10, and 15. The actuator body 81 is hinged to the rear fixed rod 90*b*, and the telescopic body 82 is hinged to the front fixed rod 90*c*. Clearly, if necessary, the actuator body 81 could be hinged to the front fixed rod 90*c* and the telescopic body 82 to the rear fixed rod 90*b*, which is not limited to the arrangement shown in FIGS. 4, 7, 10, and 15. The spring 90*a* is connected to both the rear fixed rod 90*b* and the inner linkage assembly 42 (specifically the inner intermediate connecting arm 422). With the assistance of the spring 90*a* and the telescopic actuator 80, the spring 90*a* is in a compressed state as the footrest device 30 extends, thereby providing additional force to the telescopic actuator 80, allowing it to extend the footrest device 30 more easily with less force. Additionally, with the assistance of the spring 90*a* and the telescopic actuator 80, the required number of actuators 80 is reduced. It is worth noting that the telescopic actuator 80 could, but is not limited to, be an electric push rod. Furthermore, as shown in FIGS. 4, 7, 9, 10, 12, and 15, as an example, the rear end of the inner intermediate connecting arm 422 is provided with a post 4221 for installing the front end of the spring 90*a*.

As shown in FIGS. 4, 7, 10, and 15, as an embodiment, each of the base frame 10, the seat frame 20, the backrest device 70, the backrest control assembly 60, the footrest device 30, the linkage arm 50, and the seat frame control assembly 40 is arranged in a pair and each pair is arranged in the left and right directions of the base frame 10 respectively. The left and right ends of the rear fixed rod 90*b* are each fixedly connected to the intermediate control connecting arm 65 at the same end, and the left and right ends of the front fixed rod 90*c* are each fixedly connected to the front footrest swing arm 31 at the same end, specifically to the fixed position 314 on the front footrest swing arm 31. Since the front fixed rod 90*c* is fixedly connected to the front footrest swing arm 31, the telescopic actuator 80 can more easily drive the footrest device 30 to extend.

Referring to the attached figures, the process of adjusting the sofa 1000 of the present invention from a seated position (closed mode) to a fully reclining position (relaxed mode) follows. When the sofa 1000 in the seated position shown in FIG. 1 needs to be adjusted to the reclining position (TV watching mode) shown in FIG. 2, the telescopic actuator 80 is activated. Accordingly, the telescopic actuator 80 drives the footrest device 30 to extend forward; as a result, the extending footrest device 30 causes the seat frame 20 to move forward relative to the base frame 10, by the linkage arm 50 and the seat frame control assembly 40. As the backrest control assembly 60 is hinged to the rear end 21 of the seat frame 20, the rear end 11 of the base frame 10, and the backrest device 70 respectively, thus the forward movement of the seat frame 20 causes the second control connecting arm 62, the intermediate control connecting arm 65 and the first control swing arm 61 to pivot downward in a clockwise direction, and the first control connecting arm 63 to pivot downward in a counterclockwise direction (as shown in FIGS. 5 and 8). Further, the spring 90*a* is in a compressed state as the footrest device 30 extends, thereby providing additional force to the telescopic actuator 80, allowing it to extend the footrest device 30 more easily with less force.

Figure 16:
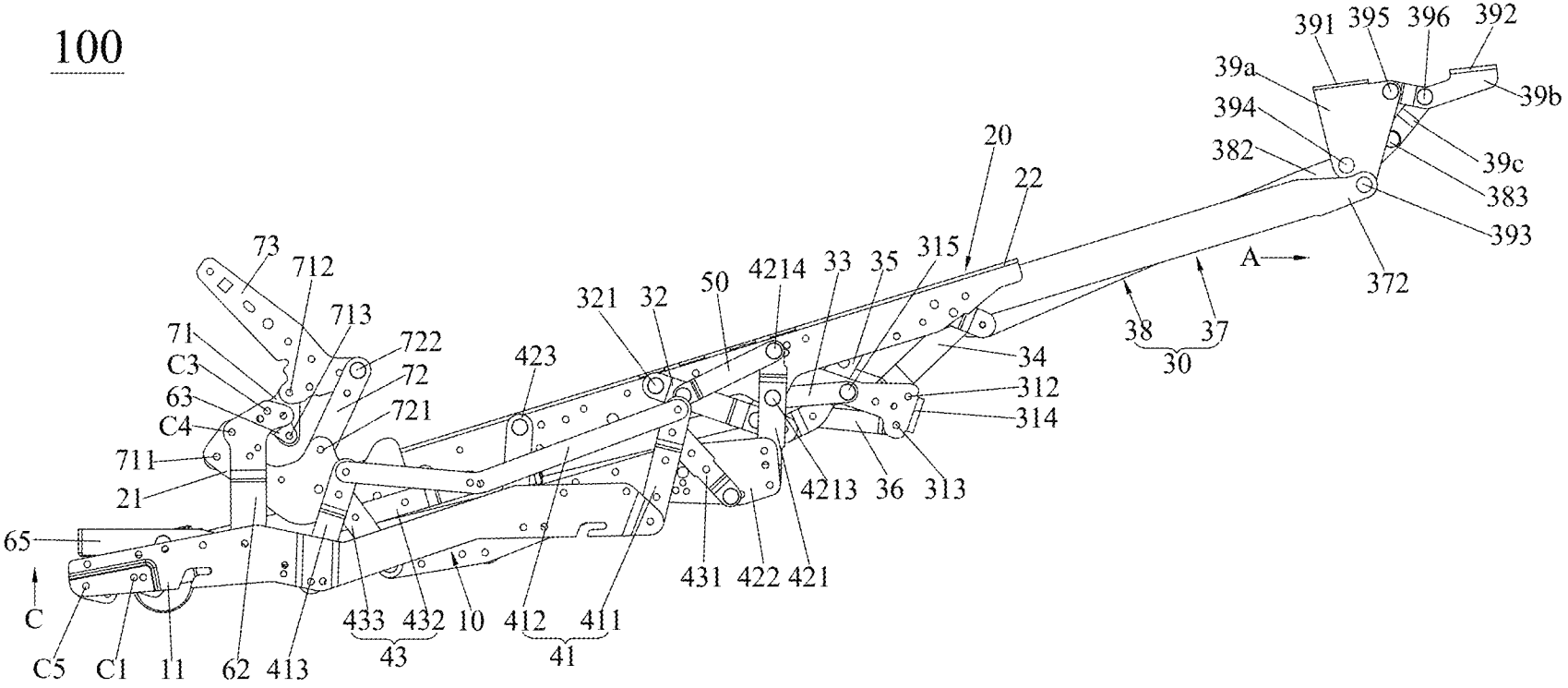
FIG. 16 is a top view of FIG. 15 viewed in the opposite direction of arrow B.

When the telescopic actuator 80 drives the footrest device 30 to fully extend forward to the position shown in FIG. 2, the telescopic body 82 of the actuator 80 continues to extend forward, causing the seat frame 20 and the backrest device 70 to move forward as well. Under the control of the backrest control assembly 60, as shown in FIGS. 11, 13, and 16, the second control connecting arm 63, intermediate control connecting arm 65, first control connecting arm 64, and first control swing arm 61 pivot clockwise downward, while the first control connecting arm 62 pivots counterclockwise downward, thereby adjusting the angle of the backrest rotating frame 73, as shown in FIG. 3 and FIG. 16. As the seat frame 20 moves from the preset intermediate position to the terminal position, the spring 90*a* is stretched.

In the expandable frame 100 for furniture in the first embodiment, the linkage arm 50 of the present invention at its tail end 51 is hinged to the inner connecting arm 421 and at its head end 50*a* is hinge to the rear footrest swing arm 32, thus, during the process of switching from the retracted position to the extended position, the footrest device 30, through the linkage arm 50, drives the seat frame control assembly 40, and causes the seat frame 20 and the backrest device 70 to switch together from the initial position to the preset intermediate position. Furthermore, the head end 50*a* of the linkage arm 50 remains in front of the tail end 50*b* of the linkage arm 50 as the seat frame 20 is switched between the initial position and the terminal position, thus the linkage arm 50 is kept in inclined state, avoiding a push-pull state, thereby ensuring stable movement of the seat frame 20 and enhancing user experience. Furthermore, during the process of switching from the retracted position to the extended position, the footrest device 30 drives the seat frame control assembly 40 through the linkage arm 50, causing the seat frame 20 together with the backrest device 70 to switch from the initial position to the preset intermediate position. When the seat frame 20 and the backrest device 70 switch to the preset intermediate position, the backrest control assembly 60 controls the backrest device 70 for angle adjustment. By this token, the angle adjustment of the backrest device 70 only occurs when the backrest device 70 follows the seat frame 20 to the preset intermediate position, which provides spatial clearance for the angle adjustment of the backrest device 70, thereby making the sofa 1000 of the present invention suitable for zero-clearance wall applications.

Referring to FIGS. 21 to 25, an expandable frame 100' for furniture according to the second embodiment is structurally similar to the expandable frame 100 for furniture according to the first embodiment, with the following differences, First, the linkage assembly 50' in the second embodiment includes a first linkage arm 51, a second linkage arm 53, and a third linkage arm 53 positioned below the seat frame 20 and extended along the base frame 10 in the front-rear direction. In contrast, the linkage assembly in the first embodiment includes a linkage arm 50. Due to these structural differences, the connections between the components vary as follows.

Figure 22:
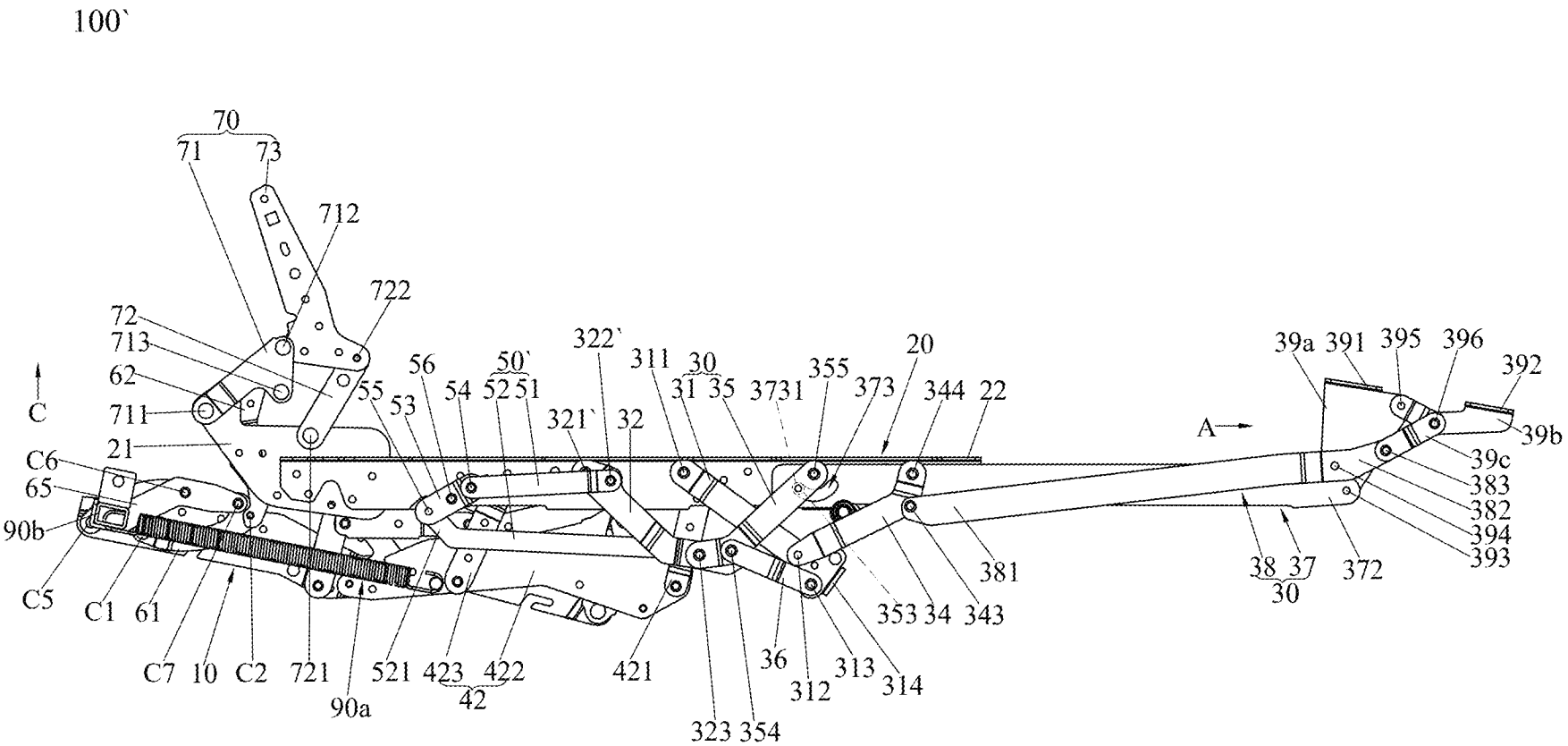
FIG. 22 is a top view of the extendable frame for furniture in the second embodiment of the present invention, with the footrest device switched to the extended position and the seat frame switched to the end position, wherein the seat frame at right side, the seat frame control assembly, the linkage assembly, the base frame, the backrest device, the backrest control assembly, the extendable actuator, and the front fixed rod are hidden.
Figure 23:
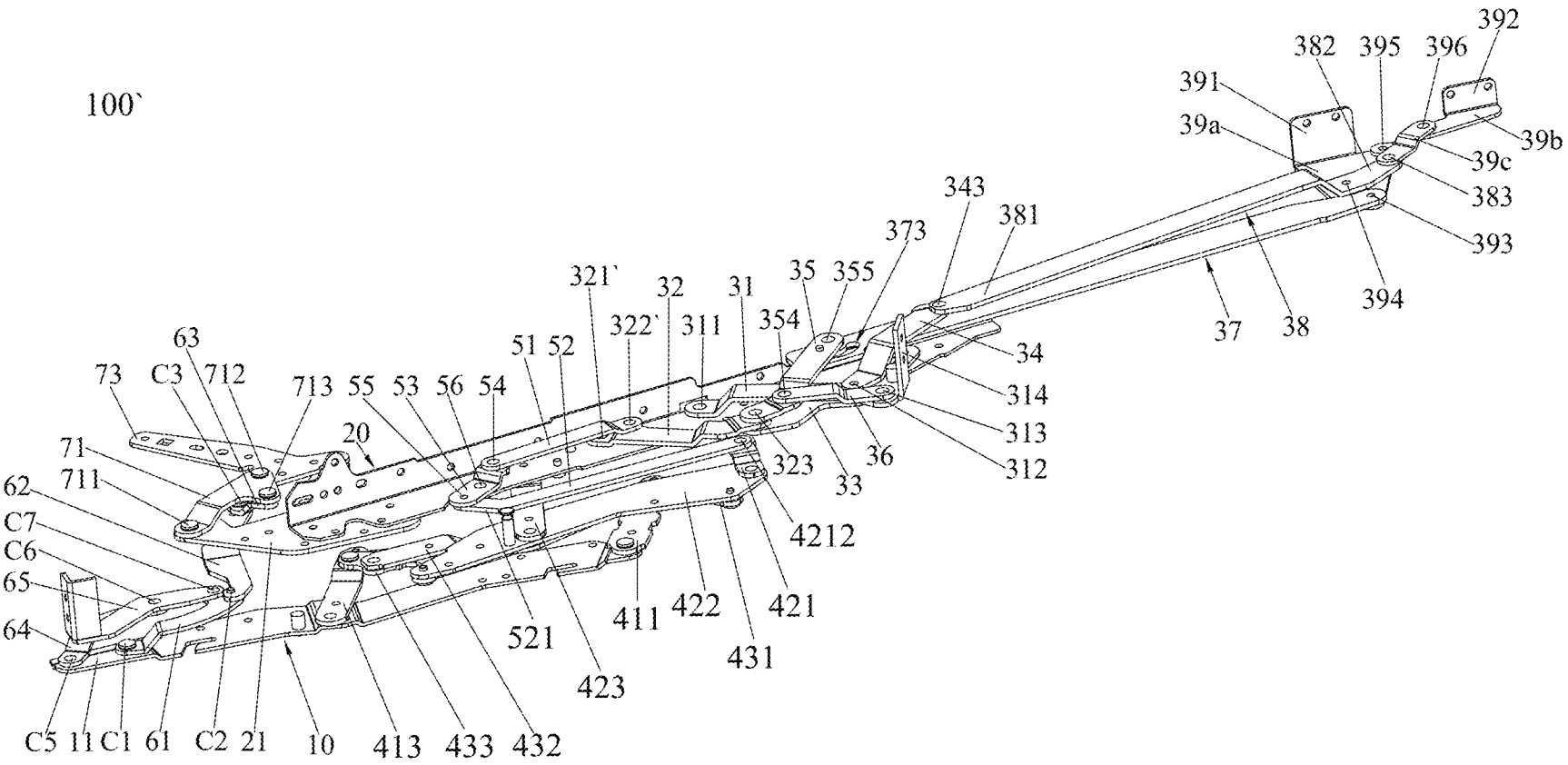
FIG. 23 is a perspective view of FIG. 22.

In the second embodiment, the first linkage arm 51 forms the head end of the linkage assembly 50', that is, the numeral 51 also is represented as the head end of the linkage assembly 50'. One end of the first linkage arm 51 is hinged to the side hinge point 322' of the rear footrest swing arm 32, while its other end is hinged to one end of the second linkage arm 53 to form a first hinge point 54. The other end of the second linkage arm 53 is hinged to the rear end of the third linkage arm 52 to form a second hinge point 55. Additionally, the second linkage arm 53 is hinged to the seat frame 20 at an intermediate position to form a third hinge point 56, creating a four-bar linkage with the seat frame 20, the rear footrest swing arm 32, the first linkage arm 51, and the second linkage arm 53. The front end of the third linkage arm 52 is hinged to the front inner connecting arm 421 at the hinge point 4212. The third linkage arm 52 forms the tail end of the linkage assembly 50', that is, the numeral 52 also is represented as the tail end of the linkage assembly 50'. Specifically, as shown in FIG. 22, as an embodiment, the rear end of the third linkage arm 52 is an upwardly inclined end 521, for pushing against the front inner connecting arm 421 smoothly and reliably.

While in the first embodiment, the head end 50*a* of the linkage arm 50 is hinged to the rear footrest swing arm 32, and the tail end 50*b* of the linkage arm 50 is hinged to the front inner connecting arm 421. Specifically, the head end 50*a* of the linkage arm 50 is hinged to the second hinge point 324 established by the rear footrest swing arm 32, and the rail end 50*b* of the linkage arm 50 is hinged to the fourth hinge point 4214 established by the front inner connecting arm 421, as shown in FIG. 11.

Figure 21:
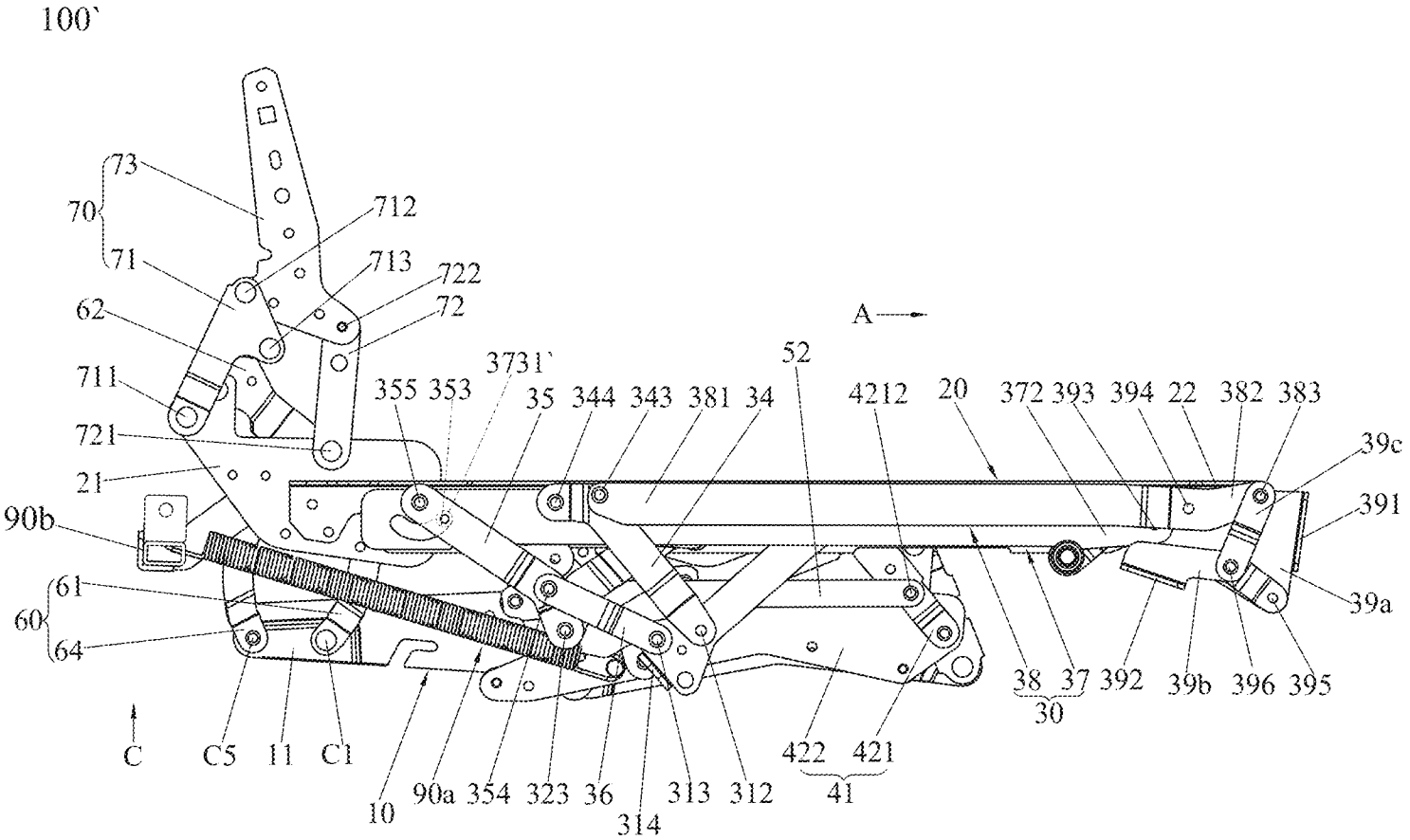
FIG. 21 is a plane view of the extendable frame for furniture in the second embodiment of the present invention, with the footrest device in the retracted position and the seat frame in the initial position, wherein the seat frame at right side, the seat frame control assembly, the linkage assembly, the base frame, the backrest device, the backrest control assembly, the extendable actuator, and the front fixed rod are hidden.

Second, in the second embodiment, an arc-shaped elongated hole 373 is provided at the rear end 371 of the first long connecting arm 37, and a limiting protrusion 353 is provided on the rear footrest connecting arm 35 and positioned within the arc-shaped elongated hole 373. When the footrest device 30 is switched to the retracted position, the limiting protrusion 353 abuts against the hole wall 3731 at one end of the arc-shaped elongated hole 373, as shown in FIG. 21. When the footrest device 30 is switched to the extended position, the limiting protrusion 353 abuts against the hole wall 3731 at the other end of the arc-shaped elongated hole 373, as shown in FIG. 22. The purpose of this configuration is to effectively prevent the footrest device 30 from over-extending or over-retracting.

While in the first embodiment, the arc-shaped elongated hole 373 is provided at the rear end 371 of the first long connecting arm 37 is provided with, but no limiting protrusion 353 is provided on the rear footrest connecting arm 35.

Third, in the second embodiment, the rear footrest swing arm 32 is provided with a second upper hinge point 321' that is hinged to the seat frame 20, a side hinge point 322' located next to the second upper hinge point 321', and a second lower hinge point 323. While in the first embodiment, the rear footrest swing arm 32 is provided with a first pivot 321 hinged to the seat frame 20, a second intermediate hinge point 322, a second lower hinge point 323, and a second hinge point 324 hinged to the linkage arm 50.

Fourth, in the second embodiment, no front intermediate hinge point 315 is provided on the front footrest swing arm 32. While in the first embodiment, the front intermediate hinge point 315 is provided on the front footrest swing arm 32.

Fifth, in the second embodiment, the front end of the first intermediate connecting arm 33 is hinged to the undermost hinge point 313, and the rear end of the first intermediate connecting arm 33 is hinged to the second lower hinge point 323. While in the first embodiment, the front end of the first intermediate connecting arm 33 is hinged to the first intermediate hinge point 315, and the rear end of the first intermediate connecting arm 30 is hinged to the second intermediate hinge point 322, as shown in FIG. 13.

Figure 24:
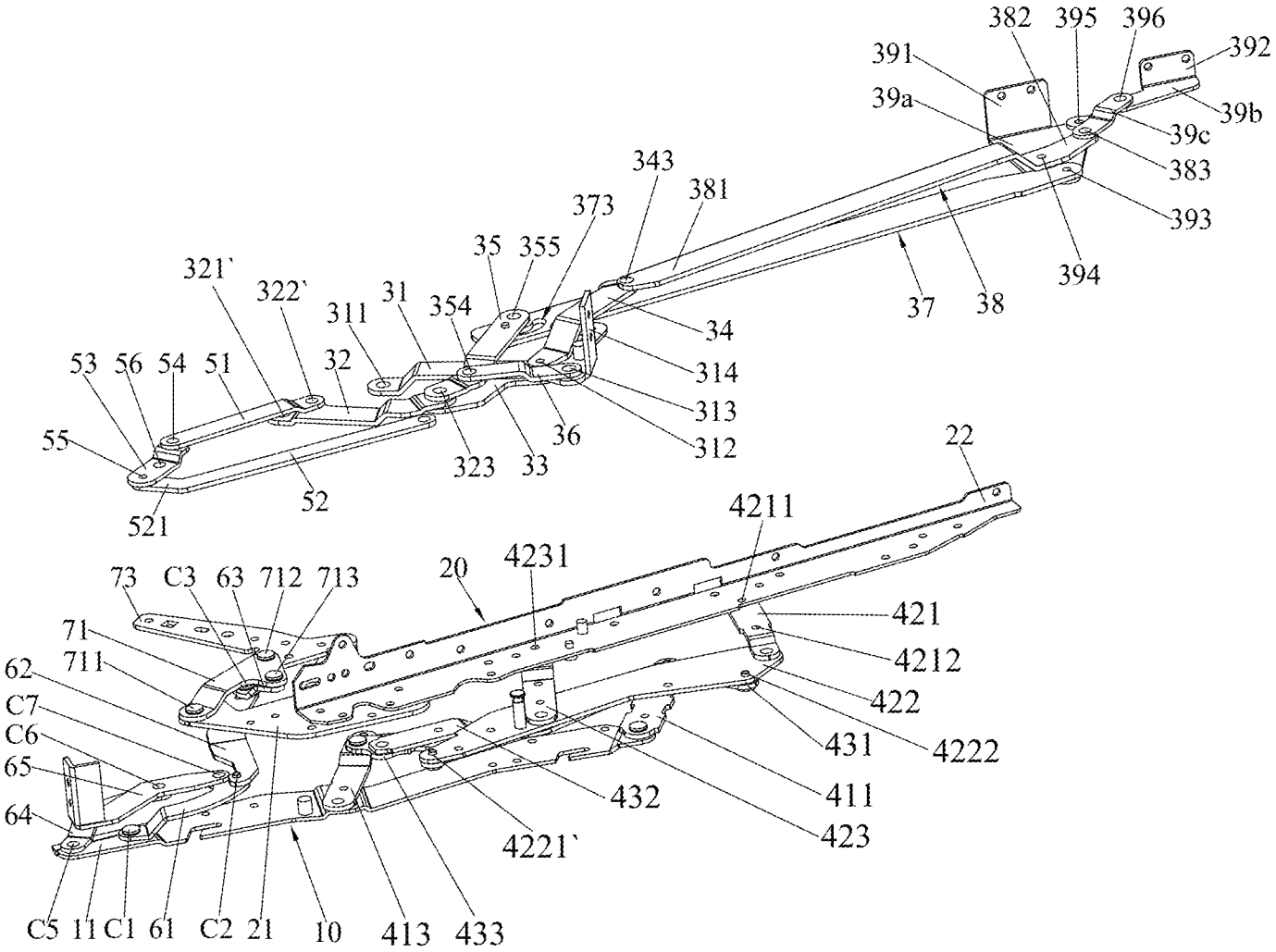
FIG. 24 is an exploded perspective view of FIG. 23.
Figure 25:
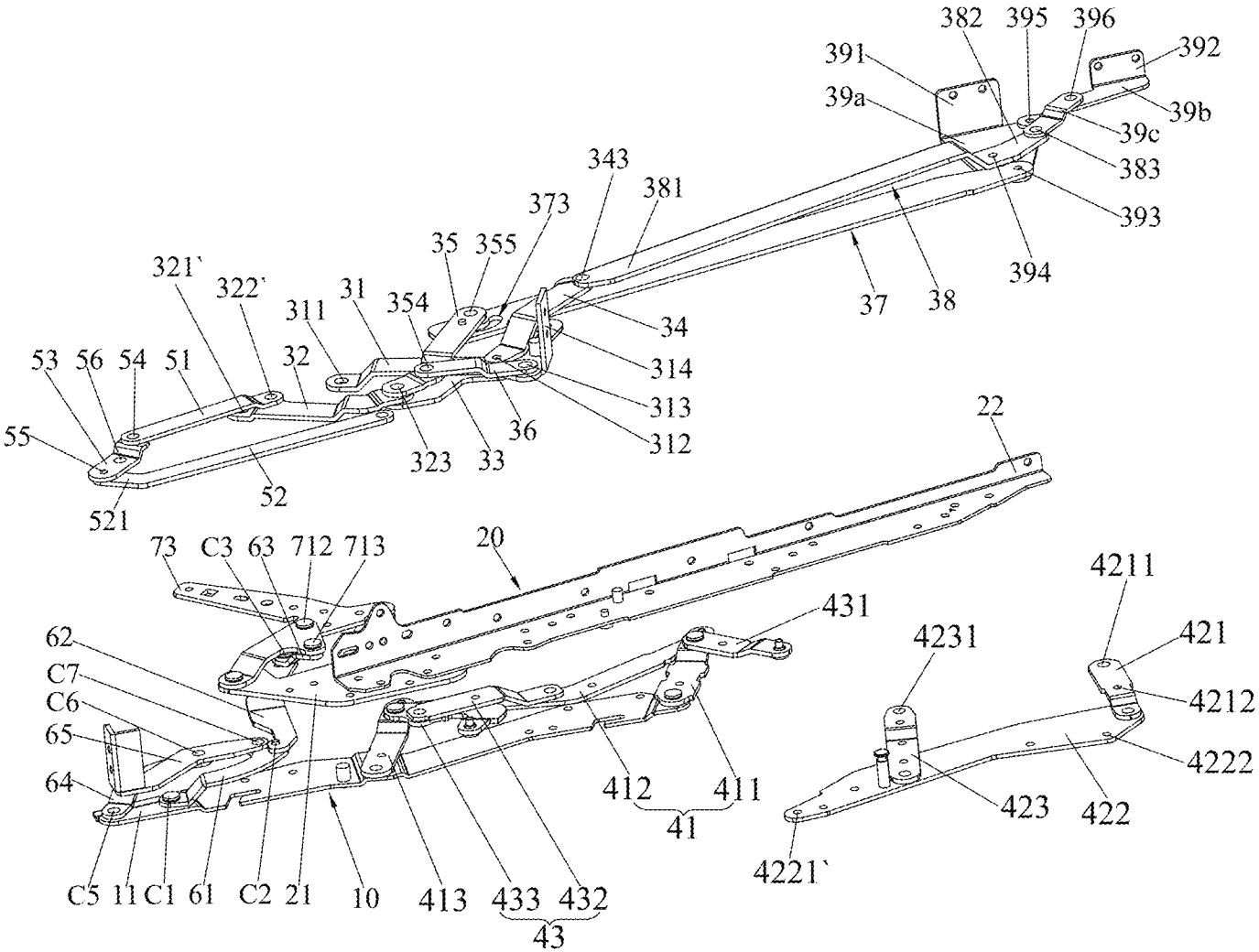
FIG. 25 is a further exploded perspective view of FIG. 24.

Sixth, in the second embodiment, the upper end of the front inner connecting arm 421 is provided with a hinge point 4211 that is hinged to the seat frame 20, and the middle section of the front inner connecting arm rod 421 is provided with a hinge point 4212 that is hinged to the tail end 52 of the linkage arm 50. The upper end of the rear inner connecting arm 423 is provided with a hinge point 4231 that is hinged to the seat frame 20, as shown in FIGS. 24 and 25. While in the first embodiment, the front inner connecting arm rod 421 is provided with a third hinge point 4213 that is hinged to the seat frame 20.

Seventh, in the second embodiment, the front end of the inner intermediate connecting arm 422 is provided with a hinge point 4222 that is hinged to the front transmission arm 431, and the rear end of the inner intermediate connecting arm 422 is provided with a hinge point 4221 that is hinged to the rear transmission arm 433.

Aside from the above differences mentioned above, the other structures are the same, which will not be repeated here.

Compared with the prior art, the linkage assembly of the present invention at its head end is hinged to the footrest device 30 and at its tail end is hinged to the inner linkage assembly 42, and the backrest control assembly 60 is respectively hinged to the rear end 11 of the base frame 10, and the backrest device 70, thus, during the process of switching from the retracted position to the extended position, the footrest device 30 drives the seat frame control assembly 40 through the linkage assembly 50, causing the seat frame 20 and the backrest device 70 to switch together from the initial position to the preset intermediate position. When the seat frame 20 and the backrest device 70 are together switched to the preset intermediate position, the backrest control assembly 60 controls the backrest device 70 for angle adjustment. By this token, the angle adjustment of the backrest device 70 only occurs when the backrest device 70 follows the seat frame 20 to the preset intermediate position, which provides spatial clearance for the angle adjustment of the backrest device 70, thereby making the sofa 1000 having the extendable frame 100 (100') of the present invention suitable for zero-clearance wall applications.

Moreover, the seat frame control assembly 40 includes an outer linkage assembly 41 that is an outer multi-bar linkage formed with the base frame 10, an inner linkage assembly 42 that is an inner multi-bar linkage formed with the seat frame 20, and a transmission assembly 43 connecting the outer linkage assembly 41 to the inner linkage assembly 42, thus the extending footrest device 30 drives the seat frame 20 forward through the linkage assembly, the inner linkage assembly 42, transmission assembly 43, and outer linkage assembly 41. As a result, when the seat frame 20 and the backrest device 70 are switched from the initial position to the preset intermediate position, the forward movement of the seat frame 20 is slower than the extension of the footrest device 30, bringing small change of the seat frame 20 relative to the base frame 10, thereby obtaining a preferable reclining position (TV watching mode).

It is important to note that "zero-clearance wall" here refers to the backrest 200 of the sofa 1000 being able to be positioned directly against the wall, with no distance in between. As an embodiment shown in FIGS. 1 to 3, the vertical centerline represents the position of the wall, and when the sofa 1000 is in the seated position, the distance between the backrest 200 of the sofa 1000 and the vertical centerline is zero. As the sofa 1000 switches from the seated position to the reclining position and the fully reclining position, the distance between the backrest 200 and the vertical centerline increases, thus preventing any collision or interference between the backrest 200 and the vertical centerline during the adjustment of the backrest 200.

It is worth noting that the direction indicated by arrow A in the drawings is from the rear to the front of the base frame 10, the direction indicated by arrow B is from left to right of the base frame 10, and the direction indicated by arrow C is from bottom to top of the base frame 10. Furthermore, from FIGS. 5, 8, 11 and 13, it is shown that under the control of the seat frame control assembly 40, the seat frame 20 also undergoes a certain angle change relative to the base frame 10 during forward movement, causing the forward and backward movements of the seat frame 20 to result in a swinging or pivoting motion. Furthermore, although the inner linkage assembly 42 forms an inner four-bar linkage with the seat frame 20, it can also form an inner five-bar linkage as needed. Similarly, although the outer linkage assembly 41 forms an outer four-bar linkage with the base frame 10, it can also form an inner five-bar linkage structure as needed.

The above disclosure is only preferred embodiments of the present invention and cannot be used to limit the scope of rights of the present invention. Therefore, any equivalent changes made in accordance with the claims of the present invention are within the scope of the present invention.

What is claimed is:

1. An extendable frame for furniture, comprising a base frame, a seat frame, a backrest device, a footrest device, and a seat frame control assembly, wherein the seat frame is movable relative to the base frame in a front-rear direction and is provided with at least an initial position, a preset intermediate position, and a terminal position; the backrest device is installed at a rear end of the seat frame, and the footrest device is installed at a front end of the seat frame and capable of switching between a retracted position and an extended position; the footrest device comprises at least one footrest swing arm hinged to the seat frame; and the seat frame control assembly is installed between the seat frame and the base frame to control a front-rear movement of the seat frame relative to the base frame;

wherein the extendable frame for furniture further comprises a linkage arm and a backrest control assembly driven by the seat frame to control an angle of the backrest device, the seat frame control assembly comprises an outer linkage assembly that is an outer multi-bar linkage formed with the base frame, an inner linkage assembly that is an inner multi-bar linkage formed with the seat frame, and a transmission assembly connecting the outer linkage assembly to the inner linkage assembly; the inner linkage assembly comprises at least one inner connecting arm hinged to the seat frame, a head end of the linkage arm is hinged to the footrest swing arm, and a tail end of the linkage arm is hinged to the inner connecting arm; the backrest control assembly is hinged to the backrest device, a rear end of the seat frame, and a rear end of the base frame; when switching from the retracted position to the extended position, the footrest device drives the seat frame control assembly through the linkage arm, enabling the seat frame and the backrest device to move together from the initial position to the preset intermediate position, with a forward movement of the seat frame being slower than an extension of the footrest device; during a process where the backrest device follows the seat frame from the preset intermediate position to the terminal position, the backrest control assembly adjusts the angle of the backrest device; during a process where the seat frame is switched from the initial position to the terminal position, the head end of the linkage arm always remains ahead of the tail end of the linkage arm.

2. A sofa, comprising a backrest, a seat cushion, and the extendable frame for furniture according to claim 1, wherein the backrest is mounted on the backrest device, and the seat cushion is mounted on the seat frame.

3. The extendable frame for furniture according to claim 1, wherein the inner linkage assembly further comprises an inner intermediate connecting arm extended in the front-rear direction of the base frame and is arranged below the seat frame; the inner connecting arm comprises a front inner connecting arm and a rear inner connecting arm respectively hinged to the inner connecting arm; the tail end of the linkage arm is hinged to the front inner connecting arm; and the outer multi-bar linkage is a four-bar linkage.

4. The extendable frame for furniture according to claim 1, wherein, in a left-right direction of the base frame, the inner linkage assembly is located on a first side of the seat frame, while the footrest device is located on an opposite second side of the seat frame; the footrest swing arm hinged to the linkage arm extends from below the seat frame to the first side of the seat frame and then upwards; and the linkage arm is arranged at an inclined angle relative to the seat frame.

5. The extendable frame for furniture according to claim 4, wherein the footrest swing arm is provided with a first pivot that is hinged to the seat frame and a second hinge point that is hinged to the linkage arm, with the first pivot positioned above the second hinge point; the inner connecting arm is provided with a third hinge point that is hinged to the seat frame and a fourth hinge point that is hinged to the linkage arm, with the fourth hinge point positioned above the third hinge point; and the third hinge point is positioned in front of the first pivot.

6. The extendable frame for furniture according to claim 1, wherein the footrest device further comprises a first intermediate connecting arm located below the seat frame and extending in the front-rear direction of the base frame; the footrest swing arm comprises a front footrest swing arm hinged to a front end of the first intermediate connecting arm and a rear footrest swing arm hinged to a rear end of the first intermediate connecting arm; and the head end of the linkage arm is hinged to the rear footrest swing arm.

7. The extendable frame for furniture according to claim 6, wherein the footrest device further comprises a front footrest connecting arm, a rear footrest connecting arm, a second intermediate connecting arm, a first long connecting arm and a second long connecting arm extended in the front-rear direction along the base frame; an upper end of the rear footrest connecting arm is hinged to a rear end of the first long connecting arm, and a lower end of the rear footrest connecting arm is hinged to the rear footrest swing arm; a lower end of the front footrest connecting arm is hinged to the front footrest swing arm, and an upper end of the front footrest connecting arm is sequentially hinged to a rear end of the second long connecting arm and the rear end of the first long connecting arm; the second intermediate connecting arm is hinged to both the rear footrest connecting arm and the front footrest swing arm; a front end of the first long connecting arm is hinged to a first footrest head with a support portion, and a position of the first footrest head distant from the first long connecting arm is hinged to a second footrest head with a support portion; the second footrest head is hinged to a short arm, and a front end of the second long connecting arm is sequentially hinged to the first footrest head and the short arm; when the footrest device is switched to the retracted position, the support portions of both the first and second footrest heads are arranged in a front-downward configuration, and the first and second long connecting arms are retracted into the seat frame; when the footrest device is switched to the extended position, the support portions of both the first and second footrest heads are arranged upward, and the first and second long connecting arms slide and extend beyond the seat frame.

8. The extendable frame for furniture according to claim 7, wherein the front footrest swing arm is provided with a first upper hinge point, a first lower hinge point, a first intermediate hinge point between the first upper hinge point and the first lower hinge points, and an undermost hinge point located beside the first lower hinge point; the seat frame is hinged to the first upper hinge point, the front footrest connecting arm is hinged to the first lower hinge point, and the first intermediate connecting arm is hinged to the first intermediate hinge point;

the rear footrest swing arm is sequentially provided with a second intermediate hinge point and a second lower hinge point; the rear footrest connecting arm is hinged to the second lower hinge point, and the first intermediate connecting arm is hinged to the second intermediate hinge point; the rear footrest connecting arm is provided with a third intermediate hinge point and a third upper hinge point connected to the rear end of the first long connecting arm; the second intermediate connecting arm is hinged to both the undermost hinge point and the third intermediate hinge point, with the third intermediate hinge point located between the second lower hinge point and the third upper hinge point; the front footrest connecting arm further has a fourth intermediate hinge point and a fourth upper hinge point, with the rear end of the second long connecting arm hinged to the fourth intermediate hinge point, and the first long connecting arm hinged to the fourth upper hinge point.

9. The extendable frame for furniture according to claim 1, wherein the backrest control assembly comprises a first control swing arm, a first control connecting arm, and a second control connecting arm, a lower end of the first control swing arm is hinged to the rear end of the base frame to form a first hinge centerline, and an upper end of the first control swing arm is hinged to a lower end of the first control connecting arm to form a second hinge centerline; an upper end of the first control connecting arm is hinged to a head end of the second control connecting arm to form a third hinge centerline; the first control connecting arm is further hinged to the rear end of the seat frame to form a fourth hinge centerline, and a tail end of the second control connecting arm is hinged to the backrest device.

10. The extendable frame for furniture according to claim 9, wherein the backrest device comprises a rear backrest swing arm, a front backrest swing arm, and a backrest rotating frame for adjusting an angle of the backrest, the rear backrest swing arm is provided with a first hinge point hinged to the rear end of the seat frame, a second hinge point hinged to the backrest rotating frame, and a third hinge point hinged to a tail end of the second control connecting arm, the third hinge point is arranged below the second hinge point; the front backrest swing arm is provided with a fourth hinge point hinged to the rear end of the seat frame and a fifth hinge point hinged to the backrest rotating frame, and the fifth hinge point is positioned above the fourth hinge point and in front of the second hinge point, while the fourth hinge point is positioned in front of the first hinge point;

wherein a distance from the first hinge centerline to the second hinge centerline is P1, a distance from the second hinge centerline to the fourth hinge centerline is P2, a distance from the fourth hinge centerline to the third hinge centerline is P3, a distance from the third hinge centerline to the third hinge point is P4, a distance from the second hinge point to the first hinge point is P5, a distance from the fourth hinge point to the fifth hinge point is P6, a distance from the first hinge point to the fourth hinge point is P7, a distance from the second hinge point to the fifth hinge point is P8, and P2>P1>P7>P5>P6>P8>P3>P4.

11. The extendable frame for furniture according to claim 9, further comprising a telescopic actuator and a spring, wherein the telescopic actuator comprises an actuator body and a telescopic body that slides telescopically on the actuator body, the backrest control assembly further comprises a second control swing arm located behind the first control swing arm and an intermediate control connecting arm extending in the front-rear direction along the base frame, a lower end of the second control swing arm is hinged to the rear end of the base frame to form a fifth hinge centerline, and an upper end of the second control swing arm is hinged to the intermediate control connecting arm to form a sixth hinge centerline; the intermediate control connecting arm is hinged to the upper end of the first control swing arm to form a seventh hinge centerline located behind the second hinge centerline; a position on the intermediate control connecting arm behind the sixth hinge centerline is connected with a rear fixed rod extending in a left-right direction of the base frame, and the footrest swing arm is connected with a front fixed rod extending in the left-right direction of the base frame; one of the actuator body and the telescopic body is hinged to the rear fixed rod, and the other of the actuator body and the telescopic body is hinged to the front fixed rod; and the spring is connected to both the rear fixed rod and the inner linkage assembly.

* * * * *